US006802973B2

(12) United States Patent
Cheng et al.

(10) Patent No.: US 6,802,973 B2
(45) Date of Patent: Oct. 12, 2004

(54) MICROPOROUS HOLLOW FIBER MEMBRANES FROM PERFLUORINATED THERMOPLASTIC POLYMERS

(75) Inventors: Kwok-Shun Cheng, Nashua, NH (US); Rajnikant B. Patel, Tewksbury, MA (US); T. Dean Gates, Bedford, MA (US)

(73) Assignee: Mykrolis Corporation, Billerica, MA (US)

( * ) Notice: Subject to any disclaimer, the term of this patent is extended or adjusted under 35 U.S.C. 154(b) by 0 days.

(21) Appl. No.: 10/436,944

(22) Filed: May 13, 2003

(65) Prior Publication Data

US 2003/0201223 A1 Oct. 30, 2003

Related U.S. Application Data

(62) Division of application No. 09/890,109, filed as application No. PCT/US00/02198 on Jan. 27, 2000.

(60) Provisional application No. 60/117,852, filed on Jan. 29, 1999.

(51) Int. Cl.[7] ..... B01D 71/26

(52) U.S. Cl. ..... 210/500.36; 210/500.23; 210/500.42; 264/41; 264/178; 264/209.1; 96/4; 96/8

(58) Field of Search ..... 210/500.36, 500.23, 210/500.42; 264/41, 178, 209.1; 96/4, 8

(56) References Cited

U.S. PATENT DOCUMENTS

| | | | |
|---|---|---|---|
| 4,902,456 | A | 2/1990 | Yen et al. |
| 4,906,377 | A | 3/1990 | Yen et al. |
| 4,990,294 | A | 2/1991 | Yen et al. |
| 5,032,274 | A | 7/1991 | Yen et al. |
| 5,154,827 | A | 10/1992 | Ashelin et al. |
| 5,158,680 | A | 10/1992 | Kawai et al. |
| 5,490,931 | A | 2/1996 | Chung et al. |
| 5,695,702 | A | 12/1997 | Niermeyer et al. |
| 5,762,789 | A | 6/1998 | de los Reyes et al. |
| 5,855,783 | A | 1/1999 | Shucosky et al. |

FOREIGN PATENT DOCUMENTS

| | | |
|---|---|---|
| DE | 3444387 | 7/1985 |
| EP | 0 175 432 | 3/1986 |
| EP | 0 217 482 | 4/1987 |
| EP | 0 299 459 | 1/1989 |
| EP | 0 340 732 | 11/1989 |
| EP | 0 343 247 | 11/1989 |
| EP | 0 559 149 | 9/1993 |
| EP | 0 803 281 | 10/1997 |
| EP | 0 855 212 | 7/1998 |
| EP | WO 00/44479 | 8/2000 |
| EP | WO 00/44480 | 8/2000 |
| EP | WO 00/44482 | 8/2000 |
| EP | WO 00/44483 | 8/2000 |
| EP | WO 00/44485 | 8/2000 |
| FR | 2 566 003 | 12/1985 |
| WO | WO 00/44484 | 8/2000 |

OTHER PUBLICATIONS

Derwent Publication XP–002142276 Abstract of JP 04 354521.

*Primary Examiner*—Ana Fortuna

(57) ABSTRACT

High flux porous hollow fiber membranes are produced from perfluorinated thermoplastic polymers by extruding heated solution of the polymer having a lower critical solution temperature directly into a cooling bath to form the porous membrane by liquid-liquid phase separation. Extrusion can be conducted either vertically or horizontally.

17 Claims, 13 Drawing Sheets

MICROPOROUS HOLLOW FIBER MEMBRANES FROM PERFLUORINATED THERMOPLASTIC POLYMERS

This application is a divisional of copending application Ser. No. 09/890,109, filed 26 Jul. 2001 as a Section 371(c) filing of International application Ser. No. PCT/US00/02198, filed 27 Jan. 2000, which designated the United States and was published in the English language as WO 00/44484 on Aug. 3, 2000. The PCT Application claims priority from the following copending and commonly owned provisional application, U.S. Ser. No. 60/117,852, filed Jan. 29, 1999.

This invention relates to a process to produce hollow fiber porous membranes from perfluorinated thermoplastic polymers. More specifically, this invention relates to a process to produce microporous membranes having an essentially skin-free surface on at least one of the inner and outer surfaces, and to the membranes produced.

BACKGROUND OF THE INVENTION

Microporous membranes are used in a wide variety of applications. Used as separating filters, they remove particles and bacteria from diverse solutions such as buffers and therapeutic containing solutions in the pharmaceutical industry, ultrapure aqueous and organic solvent solutions in microelectronics wafer making processes, and for pretreatment of water purification processes. In addition, they are used in medical diagnostic devices, where their high porosity results in advantageous absorption and wicking properties.

Hollow fiber membranes are also used as membrane contactors, typically for degassing or gas absorption applications. Contactors bring together two phases, i.e., two liquid phases, or a liquid and a gas phase for the purpose of transferring a component from one phase to the other. A common process is gas-liquid mass transfer, such as gas absorption, in which a gas or a component of a gas stream is absorbed in a liquid. Liquid degassing is another example, in which a liquid containing dissolved gas is contacted with an atmosphere, a vacuum or a separate phase to remove the dissolved gas. In an example of conventional gas absorption, gas bubbles are dispersed in an absorbing liquid to increase the gas/liquid surface area and increase the rate of transfer of the species to be absorbed from the gas phase. Conversely, droplets of liquid can be sprayed or the liquid can be transported as a thin film in counter-current operation of spray towers, packed towers, etc. Similarly, droplets of an immiscible liquid can be dispersed in a second liquid to enhance transfer. Packed columns and tray columns have a deficiency as the individual rates of the two phases cannot be independently varied over wide ranges without causing flooding, entrainment, etc. If however, the phases are separated by a membrane, the flow rates of each phase can be varied independently. Furthermore, all the area is available, even at relatively low flow rates. Due to these advantages, hollow fiber membranes are increasingly being used in contactor applications.

Hydrophobic microporous membranes are commonly used for contactor applications with an aqueous solution that does not wet the membrane. The solution flows on one side of the membrane and a gas mixture at a lower pressure than the solution flows on the other. Pressures on each side of the membrane are maintained so that the liquid pressure does not overcome the critical pressure of the membrane, and so that the gas does not bubble into the liquid. Critical pressure, the pressure at which the solution will intrude into the pores, depends directly on the material used to make the membrane, inversely on the pore size of the membrane, and directly on the surface tension of the liquid in contact with the gas phase. Hollow fiber membranes are primarily used because of the ability to obtain a very high packing density with such devices. Packing density relates to the amount of useful filtering surface per volume of the device. Also, they may be operated with the feed contacting the inside or the outside surface, depending on which is more advantageous in the particular application. Typical applications for contacting membrane systems are to remove dissolved gases from liquids, "degassing"; or to add a gaseous substance to a liquid. For example, ozone is added to very pure water to wash semiconductor wafers.

Porous contactor membranes are preferred for many applications because they will have higher mass transfer than nonporous membranes. For applications with liquids having low surface tensions, smaller pore sizes will be able to operate at higher pressures due to their resistance to intrusion. For applications in which the gas to be transferred in highly soluble in the liquid phase, the mass transfer resistance of skinned membranes is a detriment to efficient operation.

Z. Qi and E. L. Cussler (J. Membrane Sci. 23(1985) 333–345) show that membrane resistance controls absorption of gases such as ammonia, $SO_2$ and $H_2S$ in sodium hydroxide solutions. This seems generally true for contactors used with strong acids and bases as the absorption liquid. For these applications, a more porous contactor membrane, such as a microporous membrane, would have an advantage, because the membrane resistance would be reduced. This would be practical if the liquid does not intrude the pores and increase resistance. With the very low surface tension materials used in the present invention, this would be possible without coating the surface of the fibers with a low surface tension material, which is an added and complex manufacturing process step.

An advantage for contacting applications is that the very low surface tension of these perfluorinated polymers allows use with low surface tension liquids. For example, highly corrosive developers used in the semiconductor manufacturing industry may contain surface tension reducing additives, such as surfactants. These developers could not be degassed with typical microporous membranes because the liquid would intrude the pores at the pressures used and permeate, causing solution loss and excess evaporation. In addition, liquid filling the pores would greatly add to the mass transfer resistance of gas transport. U.S. Pat. No. 5,749,941 describes how conventional hollow fiber-membranes of polypropylene or polyethylene cannot be used in carbon dioxide or hydrogen sulfide absorption into aqueous solutions containing an organic solvent without the use of a solution additive to prevent leakage. While PTFE membranes would work in these applications, presumably because of their lower surface tension, they are difficult to process into hollow fibers. The membranes of the present invention are made from polymers having similar surface tension properties to PTFE and are more readily manufactured into small diameter hollow fiber membranes.

Microporous membranes have a continuous porous structure that extends throughout the membrane. Workers in the field consider the range of pore widths to be from approximately 0.05 micron to approximately 10.0 microns. Such membranes can be in the form of sheets, tubes, or hollow fibers. Hollow fibers have the advantages of being able to be incorporated into separating devices at high packing densities. Packing density relates to the amount of useful filtering surface per volume of the device. Also, they may be operated with the feed contacting the inside or the outside surface, depending on which is more advantageous in the particular application.

A hollow fiber porous membrane is a tubular filament comprising an outer diameter, an inner diameter, with a porous wall thickness between them. The inner diameter defines the hollow portion of the fiber and is used to carry fluid, either the feed stream to be filtered through the porous wall, or the permeate if the filtering is done from the outer surface. The inner hollow portion is sometimes called the lumen.

The outer or inner surface of a hollow fiber microporous membrane can be skinned or unskinned. A skin is a thin dense surface layer integral with the substructure of the membrane. In skinned membranes, the major portion of resistance to flow through the membrane resides in the thin skin. In microporous membranes, the surface skin contains pores leading to the continuous porous structure of the substructure. For skinned microporous membranes, the pores represent a minor fraction of the surface area. An unskinned membrane will be porous over the major portion of the surface. The porosity may be comprised of single pores or areas of porosity. Porosity here refers to surface porosity, which is defined as the ratio of surface area comprised of the pore openings to the total frontal surface area of the membrane. Microporous membranes may be classified as symmetric or asymmetric, referring to the uniformity of the pore size across the thickness of the membrane. In the case of a hollow fiber, this is the porous wall of the fiber. Symmetric membranes have essentially uniform pore size across the membrane cross-section. Asymmetric membranes have a structure in which the pore size is a function of location through the cross-section. Another manner of defining asymmetry is the ratio of pore sizes on one surface to those on the opposite surface.

Manufacturers produce microporous membranes from a variety of materials, the most general class being synthetic polymers. An important class of synthetic polymers are thermoplastic polymers, which can be flowed and molded when heated and recover their original solid properties when cooled. As the conditions of the application to which the membrane is being used become more severe, the materials that tan be used becomes limited. For example, the organic solvent-based solutions used for wafer coating in the microelectronics industry will dissolve or swell and weaken most common polymeric membranes. The high temperature stripping baths in the same industry consist of highly acid and oxidative compounds, which will destroy membranes made of common polymers. Since membranes made from perfluorinated thermoplastic polymers such as poly (tetrafluoroethylene-co-perfluoro(alkylvinylether)) (POLY (PTFE-CO-PFVAE)) or poly(tetrafluoroethylene-co-hexafluoropropylene) (FEP) are not adversely affected by severe conditions of use, they have a decided advantage over membranes made from less chemically and thermally stable polymers.

Being chemically inert, the POLY(PTFE-CO-PFVAE) and FEP polymers are difficult to form into membranes using typical solution casting methods. They can be made into membranes using the Thermally induced Phase Separation (TIPS) process. In one example of the TIPS process, a polymer and organic liquid are mixed and heated in an extruder to a temperature at which the polymer dissolves. A membrane is shaped by extrusion through an extrusion die, and the extruded membrane is cooled to form a gel. During cooling the polymer solution temperature is reduced to below the upper critical solution temperature. This is the temperature at or below which two phases form from the homogeneous heated solution, one phase primarily polymer, the other primarily solvent. If done properly, the solvent rich phase forms a continuous interconnecting porosity. The solvent rich phase is then extracted and the membrane dried. POLY(PTFE-CO-PFVAE) and FEP membranes made by the TIPS process are disclosed in U.S. Pat. Nos. 4,902,456, 4,906,377; 4,990,294; and 5,032,274. In the U.S. Pat Nos. 4,902,456 and 4,906,377 patents, the membranes have a dense surface with either intervals of crack-like openings or pores, either singly, or as a series of several pores. The U.S. Pat. Nos. 4,990,294 and 5,032,274 patents disclose using a coating of the dissolution solvent on the shaped membrane as it exits the die. Both surfaces consist of a dense skin with porous areas. In one embodiment, membrane produced without co-extrusion in a sheet form is stretched in the transverse direction. The membrane surface for these membranes consists of nodular appearing structures separated by crack-like openings.

U.S. Pat. No. 5,395,570 discloses a method of extrusion of hollow fiber membranes in which a quadruple extrusion head is used to extrude a hollow fiber with a lumen-filling fluid, a coating layer, and a cooling fluid layer. This method requires a complex extrusion head and flow control means, and a separate coating layer consisting of the solvent between the cooling fluid and the extruded fiber. Also, the extruded fiber is not immediately contacted with the cooling fluid, but passes to a lower zone of the extrusion head before the fourth (cooling) layer is contacted with the coated fiber.

U.S. Pat. No. 4,564,488 discloses a process for preparing porous fibers and membranes. The process involves forming a homogeneous mixture of a polymer and at least another liquid inert with respect to the polymer. The mixture must have a temperature range of complete miscibility and a temperature range where there is a miscibility gap. The mixture is extruded at a temperature above the separation temperature into a bath preferably containing entirely or for the most part the inert liquid. The bath is maintained below the separation temperature. Disclosed but not claimed is an embodiment wherein the homogeneous mixture is extruded immediately into the bath containing entirely or for the most part the inert liquid, i.e., solvent. No perfluorinated thermoplastic polymers are listed as "customary polymers" that are in the scope of the patent. No mention is made of special methods needed to extrude immediately into the cooling bath at very high temperatures.

WO 95/02447 discloses asymmetric PTFE membranes made by coating a solution of PTFE in a perfluorinated cycloalkane heated to about 340° C. onto a substrate, removing the solvent and cooling the PTFE on the substrate so that one surface of the membrane is less porous than the other, and optionally, removing the substrate. No mention is made of applying this method to unsupported hollow fiber membranes.

U.S. Pat. No. 4,443,116 discloses a process for making a porous fluorinated polymer structure. Applicable polymers are copolymers of tetrafluoroethylene and perfluorovinylether with a sulfonyl fluoride (—$SO_2F$), sulfonate ($SO_3Z$) or carboxylate (COOZ) functional group wherein Z is a cation. The presence of the polar functional group greatly facilitates solubility. A thermally induced phase separation method is used in which the solvent must crystallize after cooling and phase separation. The solvent is removed while in a solid state. No pore structure or permeability data are given.

PTFE, POLY(PTFE-CO-PFVAE) and FEP sheet membranes are disclosed in U.S. Pat. No. 5,158,680, wherein an aqueous dispersion of PTFE with particles 1 micron or less and a filament forming polymer are mixed, formed into a membrane shape and heated to above the melting temperature and then the filament forming polymer is removed.

For filtration of ultrapure solutions, vanishingly low levels of extractable residual matter is required of the membrane. The TIPS process requires only the removal of the low molecular weight extrusion solvent after extrusion. This material is easily removed by extraction with a solvent, and since the POLY(PTFE-CO-PFVAE) and FEP material is inert to the extraction solvent, no change of membrane properties occurs. Extraction is simple and thorough due to the high porosity of the membrane and the high diffusion of the low molecular weight solvent. Membranes made by extraction of a polymer or resin would meet these requirements with extreme difficulty due to the inherent difficulty of removing the slowly diffusing polymers or resins.

Previous POLY(PTFE-CO-PFVAE) and FEP membranes made from the TIPS method required extrusion through an air gap. POLY(PTFE-CO-PFVAE) and FEP membranes made by the TIPS process are disclosed in U.S. Pat. Nos. 4,902,45; 4,906,377; 4,990,294; and 5,032,274. In the U.S. Pat. Nos. 4,902,456 and 4,906,377 patents, the membranes have a dense surface with either intervals of crack-like openings or pores, either singly, or as a series of several pores. The U.S. Pat. Nos. 4,990,294, and 5,032,274 patents disclose using a coating of the dissolution solvent on the shaped membrane as it exits the die. In one embodiment, the membrane in a sheet form is stretched in the transverse direction. It was found that the rapid evaporation of the solvent at the high extrusion temperatures gave skinning and poor control of the surface porosity. To overcome the skinning problems, a solvent coating method and post-stretching were employed by previous inventors. In the solvent coating method, the solvent, hot Halocarbon oil, heated to around 300° C., is used to coat the melt surfaces as soon as the melt emerges from the die. While this method does suppress evaporation, it introduces other processing problems. First, it is very difficult to coat a melt surface uniformly with hot solvent because hot Halocarbon oil has the tendency to form droplets. Instead of a uniform coating, the solvent coating tends to streak along the melt surface. After the solution is cooled and solidified, the membrane surface shows uneven porosity due to non-uniform coating of solvent. Second, the temperature of the oil may not be uniform, and the resulting membrane would show high degree of variation of membrane properties due to uneven quenching of the surfaces. Third, the hot oil tends to soften the extruded melt and the extruded fiber tends to break apart during processing.

Post-stretching was disclosed as another technique to enhance permeability of a skinned PFA membrane in U.S. Pat. Nos. 4,990,294, and 5,032,274. While stretching does increase permeability substantially, it produces its own set of undesirable side effects. First, for stretching to be effective, the base skinned membrane must be very uniform in thickness and in mechanical strength. Any non-uniformity in the base membrane will be amplified as soon as the membrane is subjected to stretching, because weak areas stretch more than strong areas under the same stretching force. As mentioned above, it is very difficult to produce base membranes with the solvent coating technique. If solvent coating is not used, the heavy evaporation of porogen usually produces dried polymer on the die lips. This accumulated dried polymer then scratches the melt surfaces, producing lines of hidden weaknesses in the base membrane. Upon stretching, the weakened membranes break apart along the "scratch" lines.

It would therefore be desirable to have a process that would eliminate the rapid evaporation of solvent from the fiber surface, but not require a difficult coating or stretching step. It would also be beneficial to produce a skinless membrane having high surface porosity in order to utilize a large proportion of the membrane surface for permeation and retention.

It would further be desirable to have a porous hollow fiber contactor membrane for applications in which a highly soluble gas is to be transferred to a liquid having low interfacial tension.

SUMMARY OF THE INVENTION

This invention provides for high flux, skin-free hollow fiber porous membranes, more specifically, microporous membranes, from perfluorinated thermoplastic polymers, more specifically poly(tetrafluoroethylene-co-perfluoro (alkylvinylether)) (POLY(PTFE-CO-PFVAE)) or poly (tetrafluoroethylene-co-hexafluoropropylene) (FEP). These membranes are capable of operating in severe chemical environments with no apparent extractable matter being released. Compared to prior art membranes, the membranes of the invention have a higher surface porosity, which translates into high permeability or flux.

An embodiment of this invention provides for porous hollow fiber contactor membranes from perfluorinated thermoplastic polymers, more specifically poly (tetrafluoroethylene-co-perfluoro(alkylvinylether)) (POLY (PTFE-CO-PFVAE)) or poly(tetrafluoroethylene-co-hexafluoropropylene) (FEP), and their use.

A process to produce these membranes is provided. The process is based on the Thermally Induced Phase Separation (TIPS) method of making porous structures and membranes. A mixture of polymer pellets, usually ground to a size smaller than supplied by the manufacturer, and a solvent, such as chlorotrifluoroethylene oligomer, is first mixed to a paste or paste-like consistency. The polymer comprises between approximately 12% to 35% by weight of the mixture. The solvent is chosen so the membrane formation occurs by liquid-liquid, rather than solid-liquid phase separation when the solution is extruded and cooled. Preferred solvents are saturated low molecular weight polymers of chlorotrifluoroethylene. A preferred solvent is HaloVac® 60 from Halocarbon Products Corporation, River edge, N.J. Choice of the solvent is dictated by the ability of the solvent to dissolve the polymer when heated to form an upper critical solution temperature solution, but not to excessively boil at that temperature. Fiber extrusion is referred to as spinning and the extruded fiber length from the die exit to the take-up station is referred to as the spin line. The paste is metered into a heated extruder barrel where the temperature raised to above the upper critical solution temperature so that dissolution occurs. The homogeneous solution is then extruded through an annular die directly into a liquid cooling bath with no air gap. The liquid cooling bath is maintained at a temperature below the upper critical solution temperature of the polymer solution. The preferred bath liquid is not a solvent for the thermoplastic polymer, even at the extrusion temperature. Upon cooling, the heated and shaped solution undergoes phase separation and a gel fiber results. The die tip is slightly submerged for vertical spinning, i.e.; the spin line falls downward, in the direction of a freely falling body. For horizontal spinning, where the spin line exits directly in the horizontal attitude, and is maintained more or less in that plane until at least the first guide roll, a specially design die is used. The die is firmly positioned against an insulated wall with the die tip penetrating through an opening having a liquid-tight seal in the insulator wall. A trough for cooling liquid flow is placed in a recess in the opposite side of the insulating wall, in a manner that will maintain the die nose outlet in a submerged condition. Cooling liquid flows in the trough and overflows in a region of the trough of lesser depth, keeping the die nose outlet submerged with a flow of cooling liquid. In both the vertical and horizontal methods, a booster heater and temperature control means is used to briefly raise the solution temperature at the die tip to prevent premature cooling. In a subsequent step, the dissolution solvent is removed by extraction and the resultant hollow fiber membrane is dried under restraint to prevent membrane shrinkage and collapse. Optionally the dried fiber may be heat set at 200° C. to 300° C.

DETAILED DESCRIPTION OF THE EMBODIMENTS OF THE INVENTION

Figure 1:
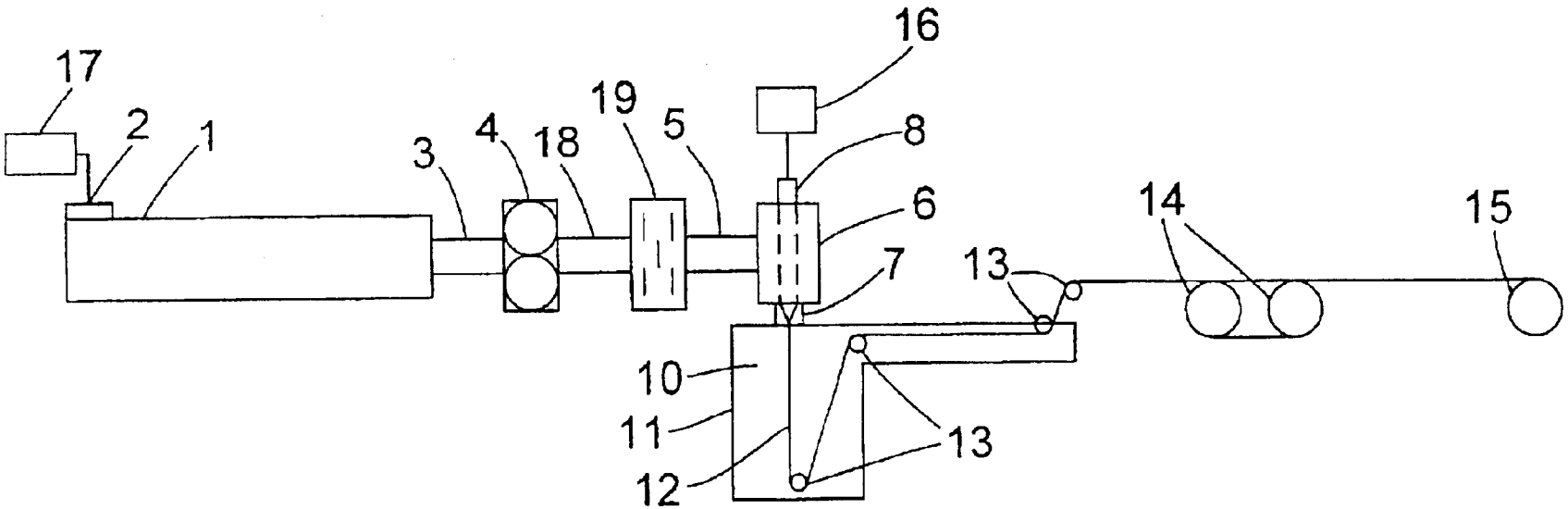
FIG. 1 is a flow diagram of the process of this invention with vertical extrusion.

A person of ordinary skill in the art of making porous membranes will find it possible to use the teachings of the present invention to produce essentially skin-free hollow fiber porous membranes from perfluorinated thermoplastic polymers which can be dissolved in a solvent to give a solution having an upper critical solution temperature, and which when the solution is cooled, separates into two phases by liquid-liquid phase separation. Examples of such polymers are poly(tetrafluoroethylene-co-perfluoro (alkylvinylether)) (POLY(PTFE-CO-PFVAE)) or poly (tetrafluoroethylene-co-hexafluoropropylene) (FEP). PFA Teflon® is an example of a poly(tetrafluoroethylene-co-perfluoro(alkylvinylether)) in which the alkyl is primarily or completely the propyl group. FEP Teflon® is an example of poly(tetrafluoroethylene-co-hexafluoropropylene). Both are manufactured by DuPont. Neoflon™ PFA (Daikin Industries) is a polymer similar to DuPont's PFA Teflon®. A poly(tetrafluoroethylene-co-perfluoro(alkylvinylether)) polymer in which the alkyl group is primarily methyl is described in U.S. Pat. No. 5,463,006. A preferred polymer is Hyflon® POLY(PTFE-CO-PFVAE) 620, obtainable from Ausimont USA, Inc., Thorofare, N.J.

With the POLY(PTFE-CO-PFVAE), PFA, and FEP polymers, saturated low molecular weight polymers of chlorotrifluoroethylene have been found to be useful solvents. A preferred solvent is HaloVac® 60, Halocarbon Products Corporation, River Edge, N.J.

Fiber Spinning Compositions

A paste of polymer and solvent is made by mixing the desired amount of weighed solvent to pre-weighed polymer in a container. The polymer has either been obtained in a particle size of approximately 100 to 1000 micron size, preferably about 300 micron size, or previously reduced to that size range by a suitable grinding process. Larger size particles do not completely dissolve in the preferred heating step, requiring additional heating time, and smaller particles require more expensive grinding which increases the cost of the process. The polymer comprises between approximately 12% to 35% of the mixture. Mixtures above approximately 35% do not give suitable porosity, and at below approximately 12% polymer content, the resulting fibers are too weak.

An example of a saturated low molecular weight polymers of chlorotrifluoroethylene is HaloVac 60. (Halocarbon Products Corporation). Choice of the solvent is dictated by the ability of the solvent to dissolve the polymer when heated to form an upper critical solution temperature solution, but not to excessively boil at that temperature. When dissolution takes place at a temperature well above the boiling point of the solvent, bubbles form in the extrudate and cause spin line breakage. The solvent need not be a single pure compound, but may be a blend of molecular weights, or copolymer ratios, of low molecular weight polymers of chlorotrifluoroethylene. Such blends can be adapted to balance solubility with suitable boiling point characteristics.

Dissolution and Extrusion

The paste is metered into the heated mixing zone of a conventional twin screw extruder and heated to a preferred temperature of about 270° C. to about 320° C., with a more preferred range of 285° C. to 310° C. preferably under an inert atmosphere, such as nitrogen, to prevent degradation of the solvent at these temperatures. The temperature is dependent on the melting temperature of the polymer being used. The extruder conveys the heated solution to an in-line heated metering pump, which feeds the solution to the annular die and controls the rate of extrusion. Optional in-line filters can be used, if required.

Fiber Extrusion

Hollow fiber membrane production presents difficulties not encountered with membrane production such as sheet membrane where the membrane is supported as is solidifies. In the case of hollow fiber production at very high temperatures, these problems are magnified. Hollow fibers are made by extruding a polymer solution or dispersion through the annular space of a die made of two concentric tubes. The inner tube carries a fluid or gas, which maintains the inner diameter defining the lumen during solidification. In operation, the polymer solution is co-extruded with the lumen fluid into a liquid bath. In the thermally induced phase separation method of this invention, the bath liquid is maintained at a temperature below which phase separation occurs for the polymer solution being used. The shaped solution cools, phase separation takes place, and the fiber solidifies. Unlike flat sheet membranes, which are coated or extruded onto a roll or a web carrier, or tubular membranes, which are formed on the inner or outer surface of a mandrel, extruded hollow fibers are not supported while they are solidifying. Since the extruded solution is not supported, the forces that transport the fiber through the cooling bath are operating directly on the shaped solution as it solidifies. If too large, the forces will pull the fiber apart.

For the fibers of the present invention, there are two inter-related problems that had to be overcome in order to have a useful process. These are the need to have a skinless membrane for high permeability, and to be able to extrude a solution that would have sufficient strength to be continuously produced at a practical rate. Perfluorinated thermoplastics melt at high temperatures, approximately 260° C.–300° C., and are difficult to dissolve. Few solvents are known and even the saturated low molecular weight polymers of chlorotrifluoroethylene found useful have limitations. For these solvents, higher molecular weight species have higher boiling points. It is commonly accepted that in a TIPS process that the boiling point of the solvent should be greater than the polymer melting temperature by 25° C.–100° C. and should have a low volatility at the extrusion temperature. (Lloyd, D. R. et al, J. Membrane Sci. 64 1–11 (1991)). However, saturated low molecular weight polymers of chlorotrifluoroethylene with boiling points greater than about 280° C. are not good solvents for these polymers. Therefore, a method had to be developed to use solvents having boiling points lower or near to the melting temperature of the polymer. At these temperatures, the solvent is very volatile and if an air gap is used, rapid loss of solvent in the air gap will increase the polymer concentration at the fiber surface and result in a skinned membrane with low permeability. To prevent skin formation from rapid evaporation of the solvent, the die outlet is submerged in the cooling bath.

Submerged extrusion, although seemingly simple, is actually very difficult to achieve practically. In the TIPS process, heated extrudate passes through an air gap before contacting the cooling surface or bath liquid. The air gap, the distance from the outlet of the die to the cooling or quenching surface, serves the very important function of allowing the melt to draw. Draw can be described by the ratio of the membrane wall thickness to the annular space of the die. The air gap allows the melt to accelerate (drawing) and to be taken up at a high and economical rate. For hollow fiber submerged extrusion, however, only a low draw ratio can be tolerated because the extruded fiber rapidly cools and solidifies as it exits the die into the cooling bath, and becomes resistant to drawing. Not being fully solidified, the fiber has a strong tendency to break. Therefore, it is necessary to spin the fibers with a low draw ratio.

In this invention, submerged extrusion was perfected to eliminate the air gap. First, to sidestep the drawing dilemma, a hollow fiber die was made with an unusually narrow die gap of about 350–400$\mu$, which defines the wall thickness. This is very close to the dimension of the final fiber so that minimal drawing is required. The die was designed and machined so that only the tip, about 1/16 of an inch, made contact with the quench liquid. This modification is crucial to the success of this technique. Since the quench liquid has a much lower temperature than the die body, submerging a conventional die would drop the temperature of the die to the point that the solution loses its ability to flow. Even with just the tip submerged, there was a decrease in the temperature of the die tip. A micro-thermocouple and a strategically located booster heater were used to control the temperature of the die Up and to raise the solution temperature at the die tip.

Figure 2:
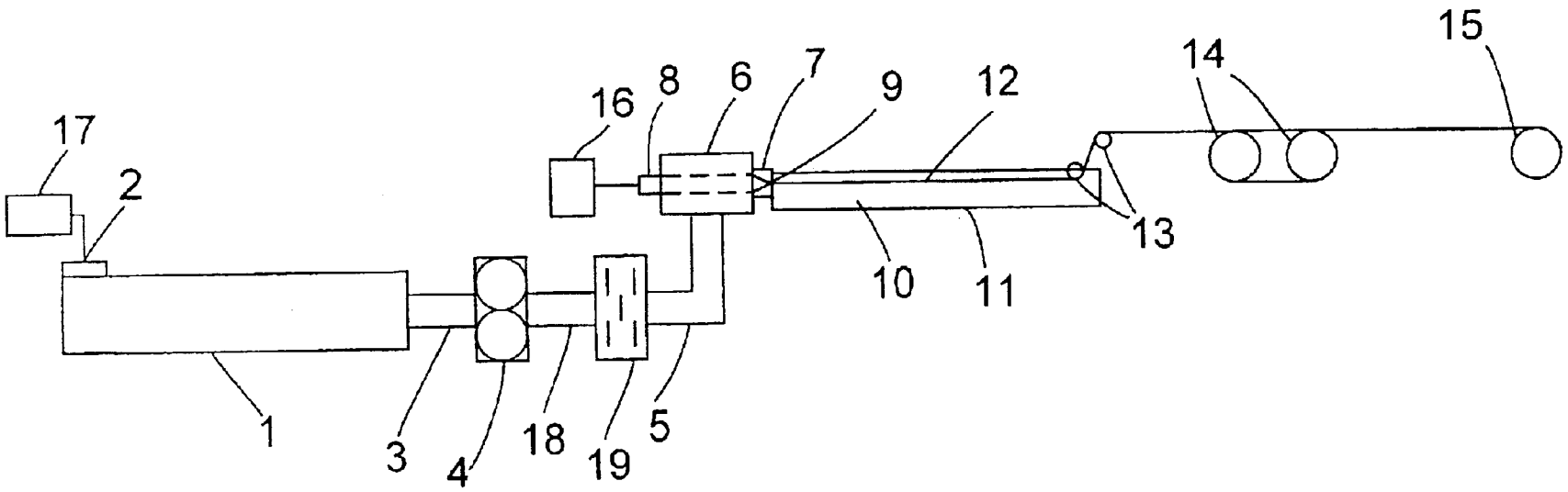
FIG. 2 is a flow diagram of the process of this invention with horizontal extrusion.

Fiber can be extruded in either of two attitudes, horizontally or vertically, as shown in FIGS. 1 and 2. The solution is metered through the annular die by the metering pump at a volumetric rate that approximately matches the take up rate of the spin line. This is necessary to prevent any significant drawdown of the fiber which will cause breakage of the weak extrudate. The inner and outer diameter, and the resulting annular space are set by the requirements for the final fiber. A wall thickness of from 100 microns to 250 microns, preferably 150 microns to 200 microns, will give a useful fiber. Spin line take-up rates are dependent on the fiber dimensions and extrusion rate. Rates of from approximately 20 to approximately 200 feet per minute can be used, with a preferred rate being approximately 100 feet per minute.

During fiber extrusion the inner diameter of the die is filled with a continuous flow of liquid to prevent the fiber lumen from collapsing. Careful control of the lumen liquid flow rate is required to prevent uncontrolled variations in fiber dimensions. The liquid should have a boiling point high enough so that boiling will not occur in the die or the extruded fiber. This can cause bubbles in the lumen and fiber breakage. The lumen liquid should not affect the fiber inner wall in a way that will cause the inner surface to densify. As, for example, by causing coagulation of the heated solution at the lumen liquid-inner wall contact interface, or by extracting solvent from this interface and increasing the surface polymer concentration. The lumen liquid can be metered into the die at room temperature, or preheated to a temperature of up to 200° C.

The die is comprised of a standard cross-head die, to which is attached a die nose. The die has two temperature control zones. The crosshead portion of the die is kept at 270° C. to 320° C., with preferred temperature range being 280° C. to 290° C. The die nose, which encompasses the die outlet, is controlled separately to a range of 290° C. to 320° C., preferably to 300° C. to 310° C. The die nose heated zone briefly raises the solution temperature to near or above the boiling point of the solvent.

FIG. 1 illustrates the die nose used for vertical fiber spinning. The solution is introduced to circular inlet 3 from the cross-head die and is transported to die exit 9. Lumen fluid is introduced to the die nose at inlet 2, and exits at the die exit. Heater 5 maintains the solution in a fluid form. Temperature sensor 6 is used with a temperature controller to maintain heater 5 at a determined temperature above the separation temperature of the solution. Die tip 9 is submerged in cooling bath 7. Gel membrane hollow fiber 8 exits the die nose through die exit 9, with the lumen fluid filling the inner diameter of the fiber.

FIG. 2 illustrate the die nose used for horizontal fiber spinning. The solution is introduced to circular inlet 13 from the crosshead die and is transported to die exit 21. Lumen fluid is introduced to the die nose at inlet 12, and exits at the die exit. Heater 15 maintains the solution in a fluid form. Temperature sensor 16 is used with a temperature controller to maintain heater 15 at a determined temperature above the separation temperature of the solution. Die tip 22 penetrates die nose/cooling bath insulator wall 19 and contacts cooling bath fluid 7 held in cooling bath trough 20. Gel membrane hollow fiber 18 exits the die tip through die exit 21, with the lumen fluid filling the inner diameter of the fiber.

For vertical extrusion, the die tip is positioned so that the exiting gel fiber dos not pass through an air gap before contacting the cooling bath. A preferred position has approximately 1.6 millimeter (1/16 inch) of the die submerged as represented in FIG. 1. For horizontal fiber spinning, the die is firmly positioned against an insulated surface as shown in FIG. 2. The die tip penetrates through an opening having a liquid-tight seal in the insulator. A trough for cooling liquid flow is placed in a recess in the opposite side of the insulating seal, in a manner that will maintain the die nose outlet in a submerged condition. The trough may be permanently fixed or retractable. The trough comprises a longer length of a depth, and a shorter length of less depth, which butts against the insulator in the recess. Optionally, the trough can be of a single depth with for example, pumping means to remove overflow cooling fluid. Cooling liquid flows in the trough and overflows the region of the trough of lesser depth, keeping the die nose outlet submerged with a flow of cooling liquid. Optionally, the trough may be placed to allow a small flow of cooling liquid between the trough end and the insulator surface.

Although PFA and POLY(PTFE-CO-PFVAE) are similar in chemical structure. POLY(PTFE-CO-PFVAE) was surprisingly different than PFA in terms of processability. PFA tended to quench very fast, possibly due to its higher melting temperature. Consequently, with submerged extrusion, it was very difficult to spin at a rate much higher than 40–50 fpm unless the lumen fluid was controlled to have a temperature between 260° C.–280° C. Since the lumen fluid would tend to boil at this temperature, spinning at a higher rate was very difficult. Under optimal conditions, the maximum spinning rate of PFA was around 24.4 meters per minute (mpm), (80 feet per minute (fpm)). Probably because of its slightly lower melting point, POLY(PTFE-CO-PFVAE) did not quench as fast. Spinning at could be done at 55.9 mpm(180 fpm). POLY(PTFE-CO-PFVAE) fibers also appear mechanically stronger then PFA, The gel fiber or dried, extracted fiber could be stretched longitudinally, resulting in significant increase in permeability.

Cooling Bath

The cooling bath lowers the temperature of the extruded fiber to below the upper critical solution temperature to cause phase separation. The bath liquid can be any liquid having a boiling point high enough to prevent bubbles from forming on the fiber exiting the die, and not adversely affecting the surface pore forming process. The bath temperature can be from 25° C. to 230° C., with a preferred range being 50° C. to 150° C.

The bath liquid can be any liquid that does not boil at the cooling temperature, or at the point where the heated extrudate enters the cooling bath, or interact with the fiber to cause a skin to form, or to dissolve or swell the polymer at the cooling bath temperature. Examples of preferred liquids are dimethylsilicone oil and di-octyl pthalate. Other di-substituted pthalates may be used.

Extraction and Drying

The gel fiber is then introduced into a liquid extraction bath of a liquid that will remove the solvent without substantially softening, weakening, or dissolving the fiber. Suitable extraction solvents include dichlorofluorethane, HCFC-141b, 1,1,2 trichlorotrifluoroethylene (Freon® TF, DuPont), hexane or similar. Extraction is usually done at from about 20° C. to about 50° C. to minimize the effect of the extracting liquid on the fiber. The extracted fiber is dried under restraint to prevent shrinkage, as on a cylindrical core, at from 20° C. to 50° C. Optionally, the fiber is then heat set at 200° C. to 300° C.

Figure 5:
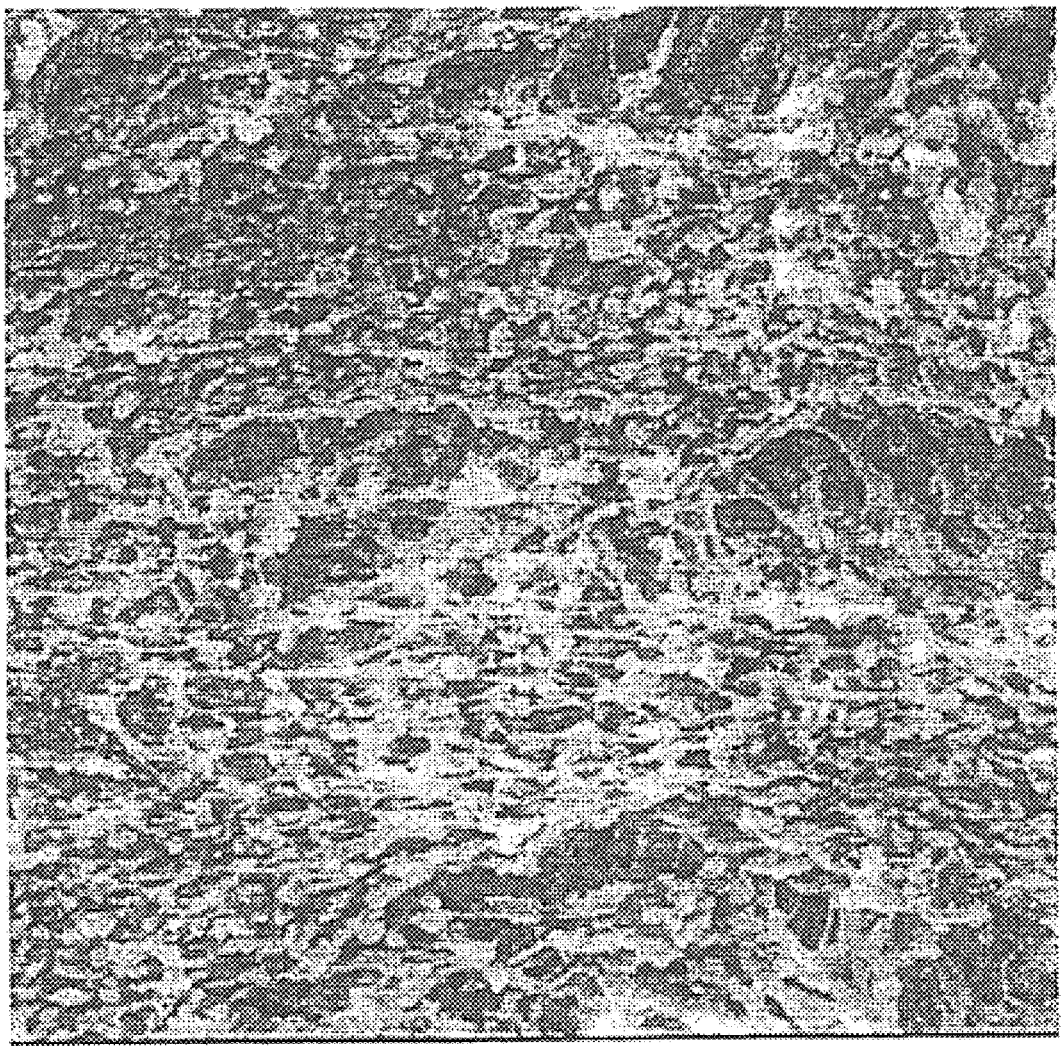
FIG. 5 is a photomicrograph at 3191X of the inner surface of a hollow fiber microporous membrane made from poly (tetrafluoroethylene-co-perfluoro(alkylvinylether)) made in accordance with Example 1, Sample #3.
Figure 6:
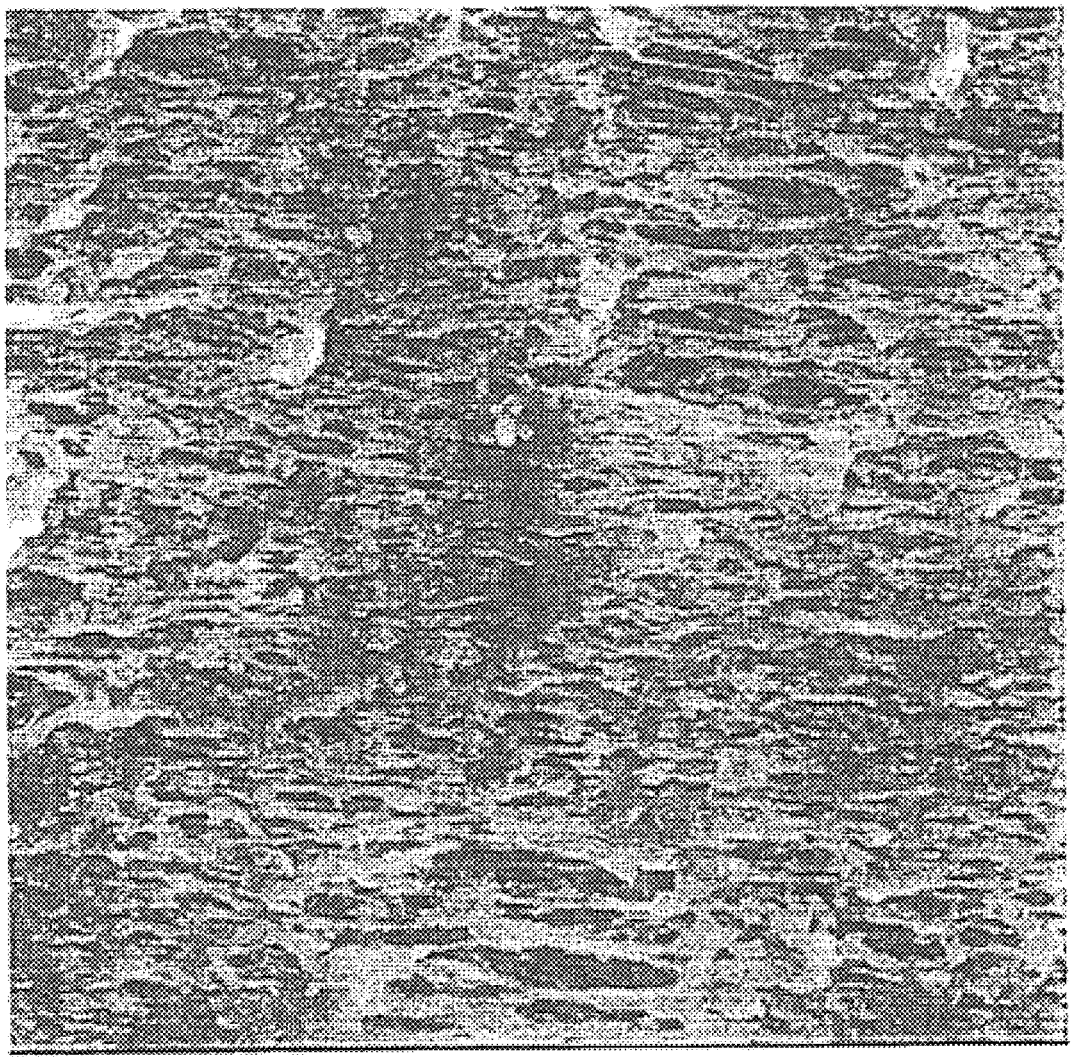
FIG. 6 is a photomicrograph at 3191X of the outer surface of a hollow fiber microporous membrane made from poly (tetrafluoroethylene-co-perfluoro(alkylvinylether)) made in accordance with Example 1, Sample #3.
Figure 7:
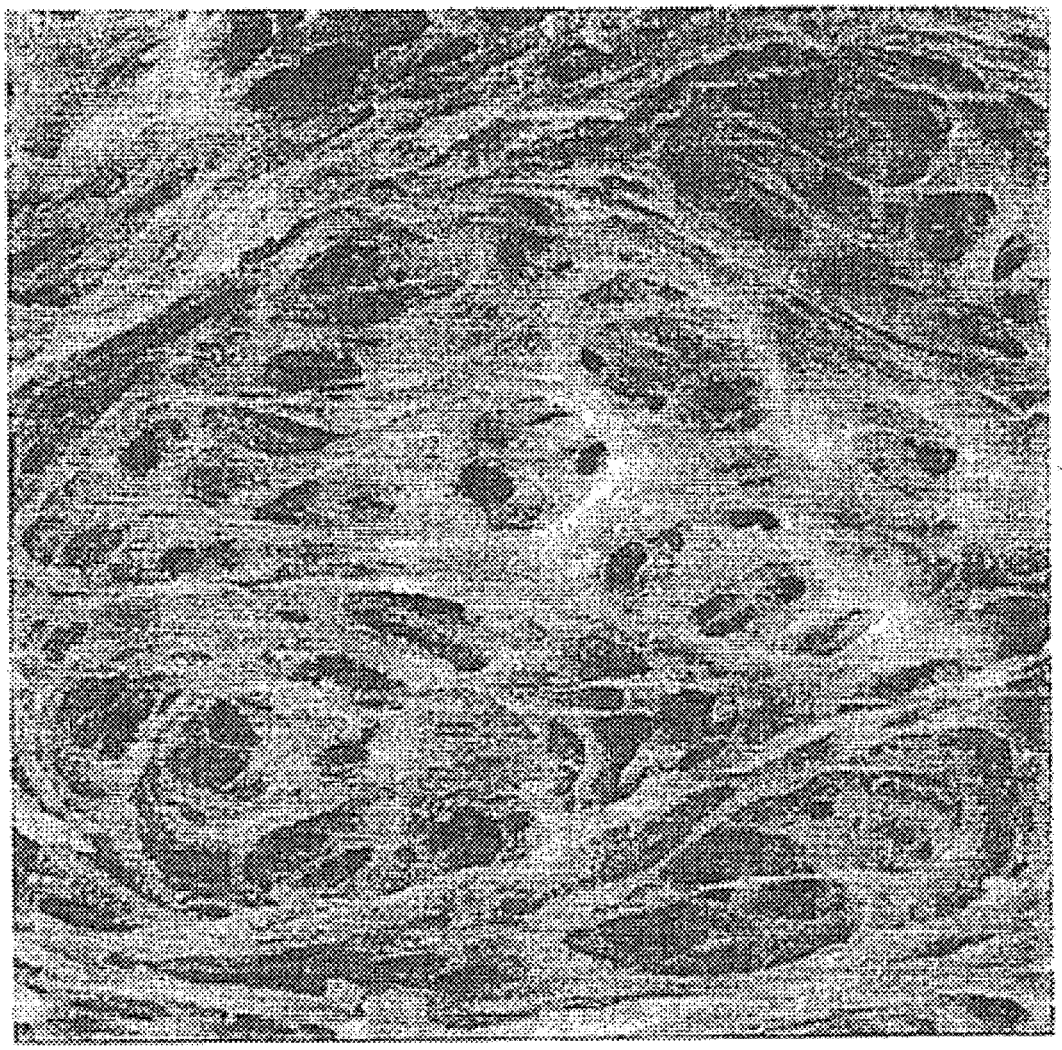
FIG. 7 is a photomicrograph at 3395X of the inner surface of a hollow fiber microporous membrane made from poly (tetrafluoroethylene-co-perfluoro(alkylvinylether)) made in accordance with Example 1, Sample #8.
Figure 8:
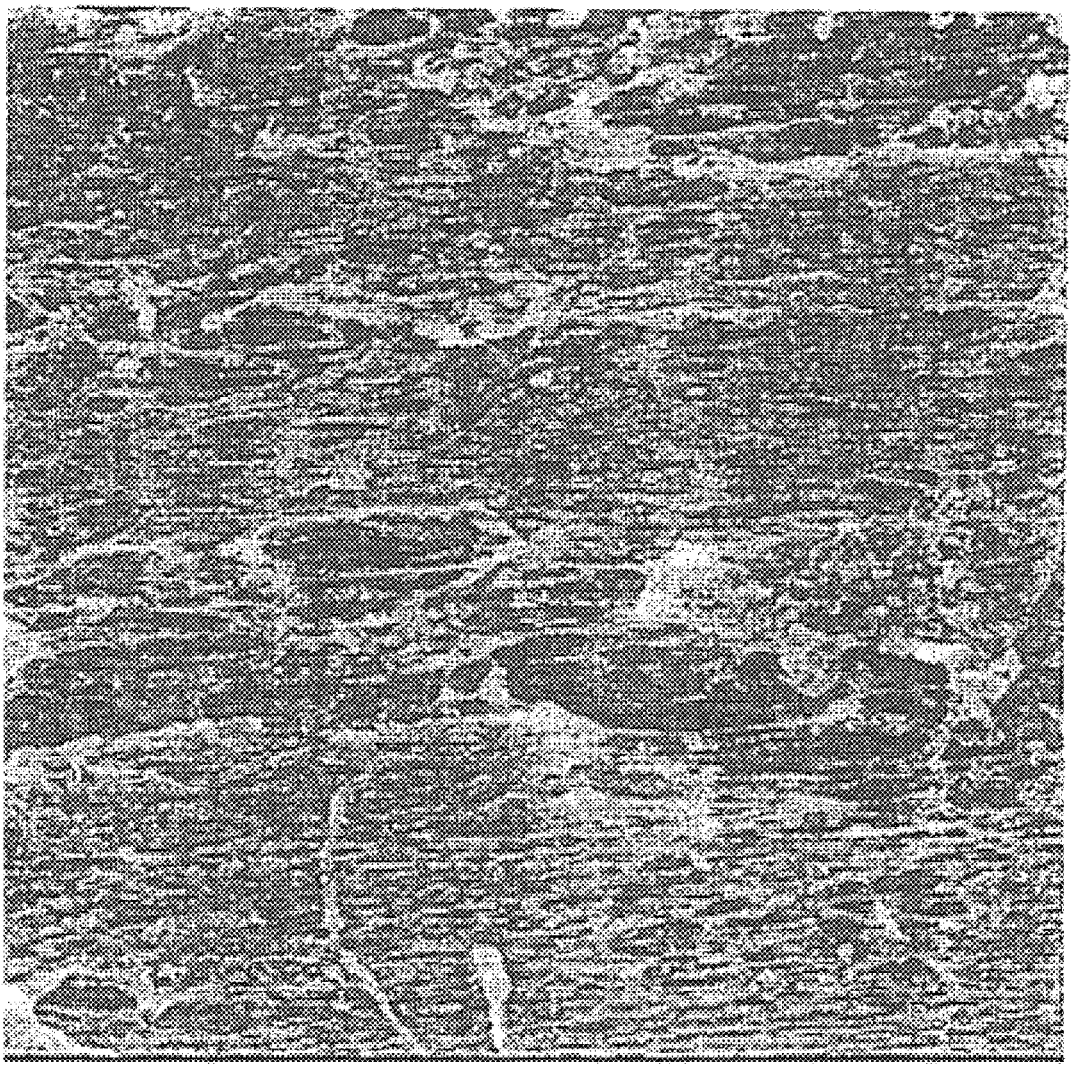
FIG. 8 is a photomicrograph at 3372X of the outer surface of a hollow fiber microporous membrane made from poly (tetrafluoroethylene-co-perfluoro(alkylvinylether)) made in accordance with Example 1, Sample #8.
Figure 9:
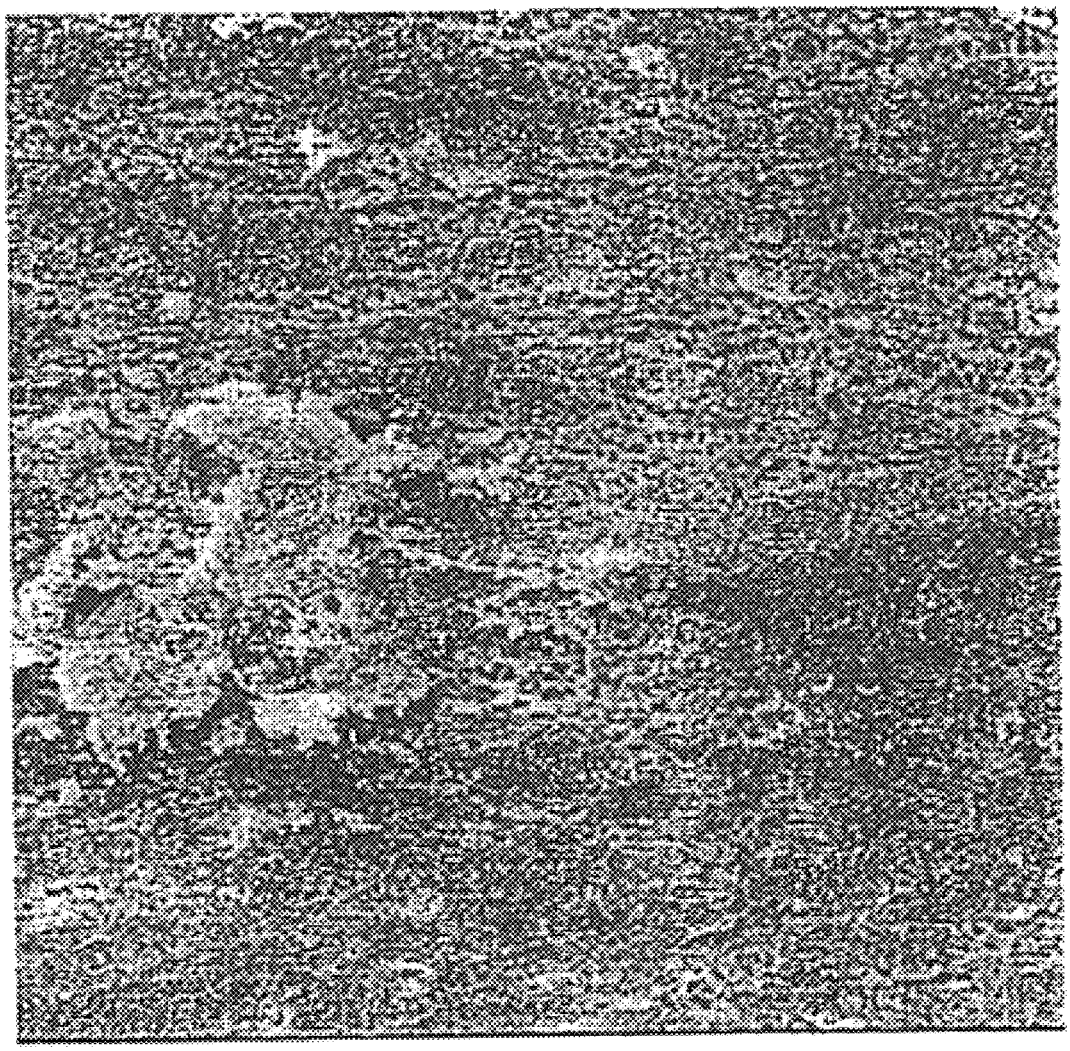
FIG. 9 is a photomicrograph at 984X of the inner surface of a hollow fiber microporous membrane made from poly (tetrafluoroethylene-co-hexafluoropropylene) (FEP), made in accordance with Example 5.
Figure 10:
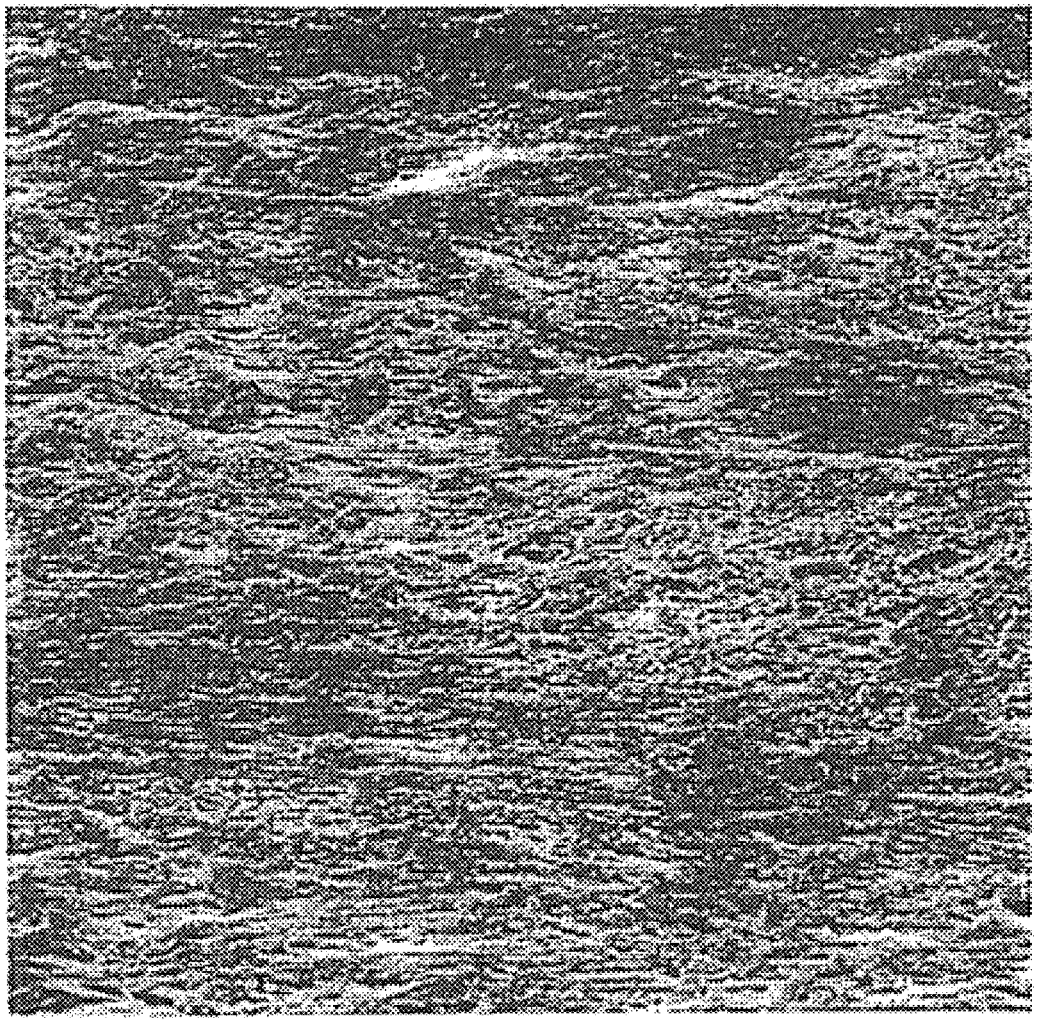
FIG. 10 is a photomicrograph at 1611 X of the outer surface of a hollow fiber microporous membrane made from poly(tetrafluoroethylene-co-hexafluoropropylene) (FEP), made in accordance with Example 5.

The advantage of the submerged extrusion method is that it can produce hollow fiber membrane continuously in practical lengths. Perfluorinated thermoplastic hollow fiber membranes made by prior art methods break easily during extrusion and practical lengths cannot be collected. The membranes produced by the submerged extrusion method have high surface porosity and good permeability. FIGS. 5 and 6 show the inner and outer surfaces respectively for a fiber of Example 1, sample #3. The inner surface has an unskinned surface consisting of nodules. The outer surface is made up of fibrous-like oriented structures. FIGS. 7 and 8 show the inner and outer surfaces respectively of a fiber of Example 1, Sample #8. The inner surface is made up of fiber-like structures in a whorl-like pattern, and the outer surface is primarily made up of oriented fiber-like structures. FIGS. 9 and 10 show the inner and outer surfaces respectively of a fiber of Example 5. Both surfaces are highly porous, with no smooth skin regions. These Figures illustrate various highly porous or skinless surfaces that can be produced in a continuous process by the submerged extrusion method. It can be appreciated that high surface porosity of the skinless membranes of the present invention will be less likely to become plugged up or fouled by particulates during a filtering operation. This will result in longer and more effective operation of the membrane.

Figure 3:
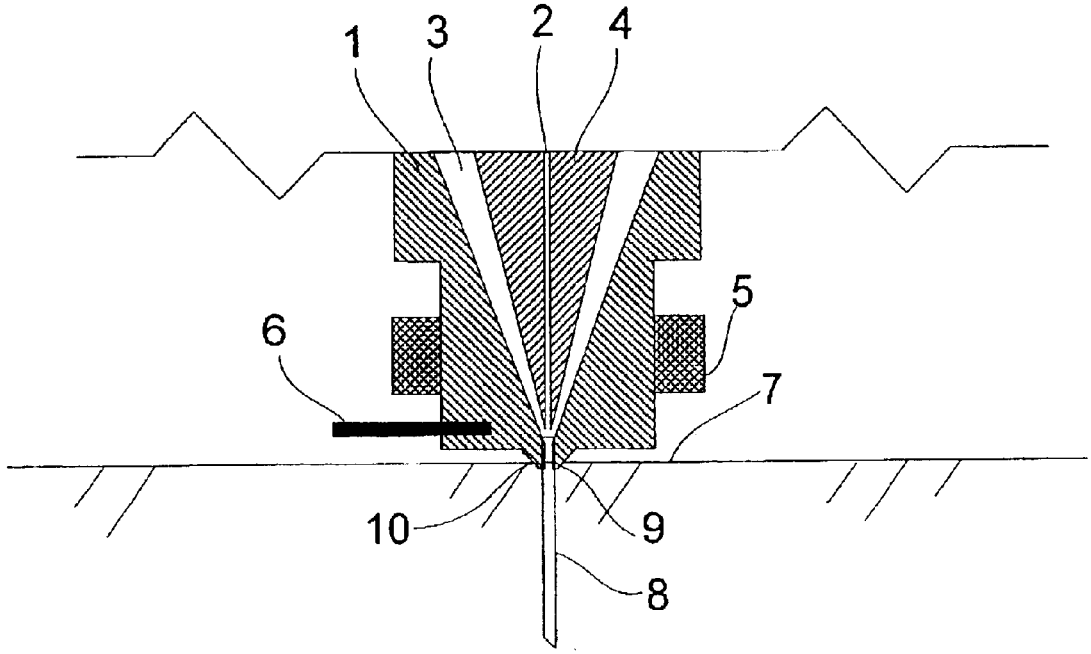
FIG. 3 is a drawing of the die used in vertical fiber spinning.

FIG. 3 illustrates a typical process for vertical spinning to produce the hollow fibers of the invention. The polymer/solvent paste-like mixture is introduced into a heated barrel extruder 31 through inlet 32, by means of a pumping system 47, for example, a progressive cavity pump. A solution is formed is formed in the heated barrel of extruder 31. Extruder 31 conveys the heated solution through conduit 33 into melt pump 34 that meters the solution, and then through conduit 35 to cross head die 36. Optionally, the solution is conveyed from extruder 31 through conduit 33 into melt pump 34, and then through conduit 48 to solution filter 49, and then through conduit 35 to cross head die 36.

The solution passes through the crosshead die 36 and into the die nose 1 where the solution is formed into a hollow fiber shape. The lumen fluid is introduced from die mandrel 38 to the inner diameter of the hollow fiber solution exiting from the die. The lumen fluid is supplied to die mandrel 38 by means of lumen fluid supply means 46.

For vertical fiber spinning, the solution with lumen fluid is extruded from die nose 1 vertically with no air gap into cooling bath fluid 7 contained in cooling bath 41 where the solution is cooled to effect the microphase separation of polymer and solvent into a gel membrane hollow fiber 8. The gel membrane hollow fiber 8 is guided through the cooling bath 41 by guide rollers 43 and is removed from the cooling bath 41 by Godet rolls 44. The gel membrane hollow fiber 8 is removed from the Godet rolls 44 by cross winder 45.

Figure 4:
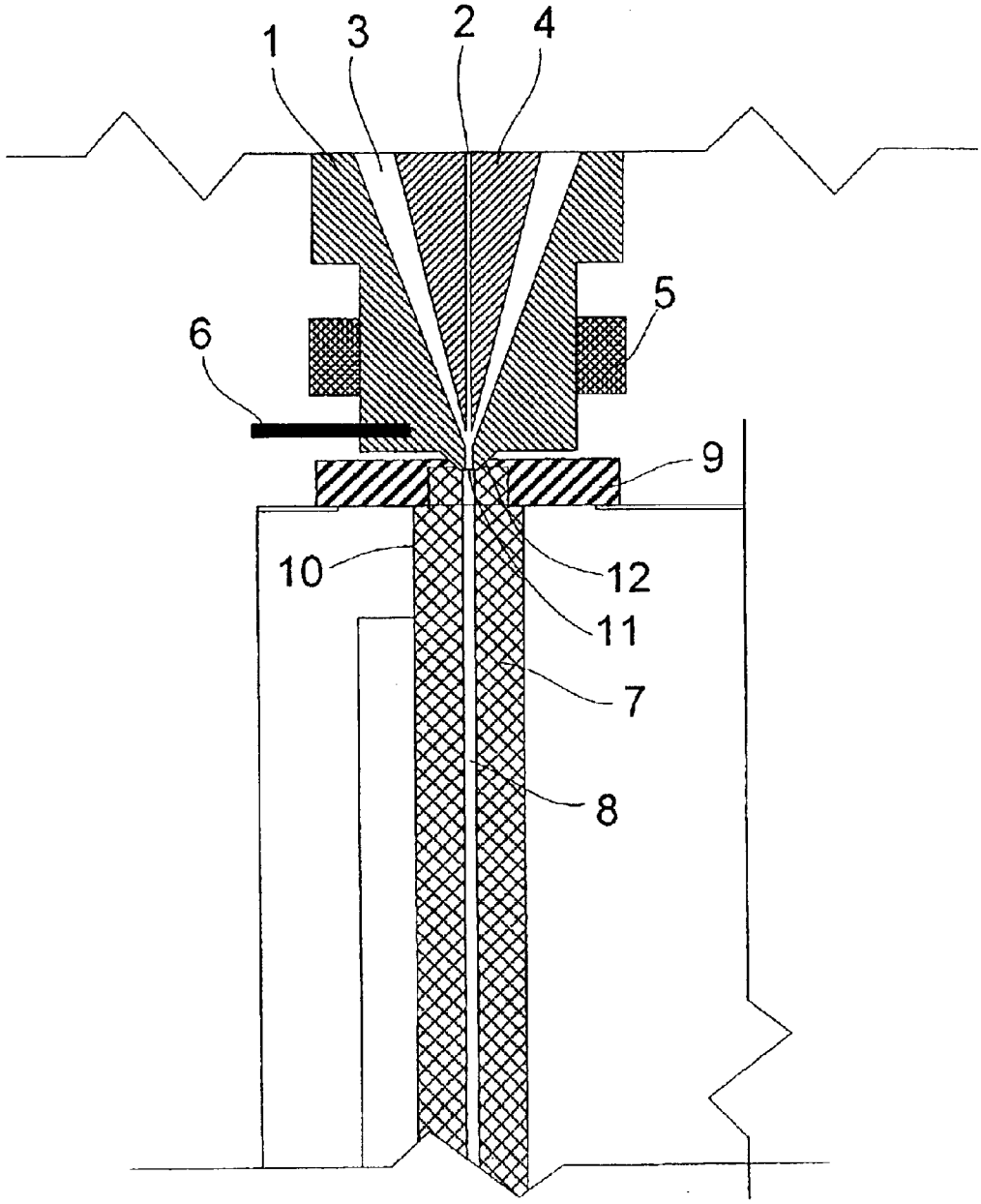
FIG. 4 is a drawing of the die used in horizontal fiber spinning.

FIG. 4 illustrates a typical process for horizontal spinning to produce the hollow fibers of the invention. The polymer/solvent paste-like mixture is introduced into a heated barrel extruder 31 through inlet 32, by means of a pumping system 47, for example, a progressive cavity pump. A solution is formed is formed in the heated barrel of extruder 31. Extruder 31 conveys the heated solution through conduit 33 into melt pump 34 which meters the solution, and then through conduit 35 to cross head die 36. Optionally, the solution is conveyed from extruder 31 through conduit 33 into melt pump 34, and then through conduit 48 to solution filter 49, and then through conduit 35 to cross head die 36.

The solution passes through the crosshead die 36 and into the die nose 1 where the solution is formed into a hollow fiber shape. The lumen fluid is introduced from die mandrel 38 to the inner diameter of the hollow fiber solution exiting from the die. The lumen fluid is supplied to die mandrel 38 by means of lumen fluid supply means 46.

For horizontal fiber spinning, the solution with lumen fluid is removed from the die nose 1 through the die/cooling bath insulator wall 19 with no air gap into cooling bath fluid 20 contained in cooling bath 51 where the solution is cooled to effect the microphase separation of polymer and solvent into a gel membrane hollow fiber 18.

The gel membrane hollow fiber 18 is guided through the cooling bath 51 by guide rollers 43 and is removed from the cooling bath 51 by Godet rolls 44. The gel membrane hollow fiber 18 is removed from the Godet rolls 44 by cross winder 45.

Solvent is then removed from the gel fiber by extraction with a solvent that will not significantly weaken or deleteriously affect the hollow fiber membrane. The fiber is then dried under restraint to minimize shrinkage. Optionally, the fiber may be stretched in the longitudinal direction. Optionally, the fiber may be heat set.

The resulting perfluorinated thermoplastic porous hollow fiber membranes of the present invention have porous surfaces on inner and outer surfaces and at least one surface having no skin. The membranes have flow properties characterized by flow times (described below) of less than 3000 seconds.

Contactor Membranes

In the contactor embodiment of the invention, the same hollow fiber membrane manufacturing process as described for porous membranes is used, with some differences in the operating ranges of the process parameters.

The percent solids of the fiber spinning solution is from about 25% to about 40%, with a preferred range of from about 28% to about 33%. The paste is metered into the heated mixing zone of a conventional twin screw extruder and heated to a preferred temperature of about 270° C. to about 320° C., with a more preferred range of 285° C. to 310° C. In fiber extrusion, wall thicknesses of from 50 microns to 250 microns, preferably 100 microns to 150 microns, will give a useful fiber. Outer diameter/inner diameter ranges typically are 800–1200/400–700 microns. Spin line take-up rates are dependent on the fiber dimensions and extrusion rate. Rates of from approximately 20 to approximately 200 feet per minute can be used, with a preferred rate being approximately 100–150 feet per minute.

During fiber extrusion the inner diameter of the die is filled with a continuous flow of liquid to prevent the fiber lumen from collapsing. Careful control of the lumen liquid flow rate is required to prevent uncontrolled variations in fiber dimensions. The liquid should have a boiling point high enough so that boiling will not occur in the die or the extruded fiber. This can cause bubbles in the lumen and fiber breakage. The lumen liquid should not affect the fiber inner wall in a way that will cause the inner surface to densify. As, for example, by causing coagulation of the heated solution at the lumen liquid-inner wall contact interface, or by extracting solvent from this interface and increasing the surface polymer concentration. The lumen liquid can be metered into the die at room temperature, or preheated to a temperature of up to about 250° C., with a preferred range of 215° C. to 235° C.

The die is comprised of a standard crosshead die, to which is attached a die nose. The die has two temperature control zones. The crosshead portion of the die is kept at 270° C. to 320° C., with preferred temperature range being 290° C. to 310° C. The die nose, which encompasses the die outlet, is controlled separately to a range of 290° C. to 350° C., preferably to 320° C. to 340° C. The die nose heated zone briefly raises the solution temperature to near or above the boiling point of the solvent.

The cooling bath lowers the temperature of the extruded fiber to below the upper critical solution temperature to cause phase separation. The bath liquid can be any liquid having a boiling point high enough to prevent bubbles from forming on the fiber exiting the die, and not adversely affecting the surface pore forming process. The bath temperature can be from 25° C. to 230° C., with a preferred range being 50° C. to 150° C.

Characterization Methods

Flow Rate Test

Two strands of fiber are loops to fit into a ¼" polypropylene tubing about 1" long. A hot melt gun is used to force hot melt glue through the open end of the tubing to pot the fibers. Normally, the glue does not fill up all the spaces between the fibers. To complete the potting, hot melt glue is applied to the other end of the tube. The length of the fibers, from the end of the potting to the loop, should be about 3.5 centimeters. After the hot melt glue solidifies, the tubing is cut to expose the fiber lumens. The fiber OD is measures under a microscope. The tubing with the fiber loop is mounted into a test holder. Isopropyl alcohol (IPA) is poured into the holder, the holder sealed, and gas pressure is set to 13.5 psi. The time interval to collect a set amount of IPA permeate is recorded.

Sample Calculations $$\text{IPA Flow RATE}=V/(T*\pi*OD*N*L)$$

IPA FlowTime (FT)=seconds to collect 500 ml IPA permeate; calculated from the time measured to collect a convenient volume from the set-up described.

where;

v=volume of permeate

T=time

OD=outside diameter of fiber

N=number of fibers

L=total length of one strand of exposed fiber

Visual Bubble Point

The potted fiber loop is mounted in a bubble point test holder. The loop is submerged in a glass container of IPA. Air pressure is slowly increased in the lumen of the fibers.

The pressure at which the first bubble appears at the outer surface of the fibers is registered as the visual bubble point.

Mean Bubble Point

A method similar to ASTM F316-80 was used to determine mean bubble point. A curve of airflow through a potted sample versus pressure was plotted for a dry sample and for the same sample wetted with IPA. The mean bubble point is the pressure at which the wet airflow is one half the dry airflow.

Scanning Electron Microscopy Images

Samples of hollow fiber membrane are soaked in isopropyl alcohol or a mixture of isopropyl alcohol and water, approximately 50% by volume. The wetted sample is then soaked in water to replace the alcohol. The water-wetted sample is held by a tweezer and dipped in a container of liquid nitrogen. The sample is then removed and quickly snapped by bending using a pair of tweezers. Approximately 2 millimeter cut sample is fixed to a sample stub with conductive carbon paint (Structure Probe Inc. West Chester Pa.). Microscopy is done with an ISI-DS130c scanning electron microscope (International Scientific Instruments, Inc, Milpitas, Calif.). Digitized images are acquired by a slow scan frame grabber and stored in TIF format.

EXAMPLE 1

Pellets of Hyflon® POLY(PTFE-CO-PFVAE) 620 (Ausimont) was mixed with HaloVac 60 from Halocarbon Oil Inc. to produce a paste of 18% by weight, which was fed by a Moyno pump into a Baker-Perkins MPCN-30; L/D=13 twin-screw extruder operating at 200 RPM in the horizontal fiber spinning mode. Extrusion and run conditions are shown in Tables 1 and 2 below. A Zenith melt pump was used to meter the melt into a hollow fiber die. The die annulus was about 400$\mu$. Heated Halocarbon oil 1000N was used as lumen fluid to maintain the hollow portion of the fiber. The melt pump and the lumen fluid pump were adjusted to produce a fiber with about 200$\mu$ wall and 500$\mu$ lumen. The bath liquid was dioctyl pthalate. After centering of the lumen needle, the die was submerged under the quench liquid for about 1/16" and the fiber was taken up by a set of Godet rolls. The fiber was extracted with Genesolv® 2000, Allied-Signal, Morristown, N.J., dried and then annealed at 275° C. Fiber Characterization data are given in Table 3.

TABLE 1

| | Extruder Barrel temperatures (° C.) | | | | Melt | Temperatures (° C.) | |
|---|---|---|---|---|---|---|---|
| Sample # | Zone 1 | Zone 2 | Zone 3 | Zone 4 | temperature (° C.) | Die body | Die Nose |
| 1 | 230 | 290 | 285 | 285 | 285 | 280 | 310 |
| 2 | 230 | 290 | 285 | 285 | 285 | 275 | 310 |
| 3 | 230 | 290 | 285 | 285 | 285 | 275 | 310 |
| 4 | 230 | 290 | 285 | 285 | 285 | 275 | 310 |
| 5 | 230 | 290 | 280 | 280 | 277 | 280 | 310 |
| 6 | 230 | 290 | 280 | 280 | 277 | 280 | 310 |
| 7 | 230 | 290 | 280 | 280 | 277 | 280 | 310 |
| 8 | 230 | 300 | 280 | 280 | 285 | 280 | 310 |

TABLE 2

| Sample # | Take-up rate (fpm) | Lumen pump rate (rpm) | Cooling bath Temperature (° C.) |
|---|---|---|---|
| 1 | 100 | 20 | 55 |
| 2 | 100 | 25 | 100 |

TABLE 2-continued

| Sample # | Take-up rate (fpm) | Lumen pump rate (rpm) | Cooling bath Temperature (° C.) |
|---|---|---|---|
| 3 | 130 | 25 | 100 |
| 4 | 130 | 15 | 100 |
| 5 | 100 | 30 | 100 |
| 6 | 100 | 35 | 100 |
| 7 | 100 | 45 | 100 |
| 8 | 200 | 25 | 100 |

TABLE 3

| Sample # | Outer diameter Microns | Wall thickness microns | Visual IPA bubble point (psi) | Mean IPA bubble-point (psi) | Flow Time (sec) |
|---|---|---|---|---|---|
| 1 | 940 | 191 | 16 | 39.5 | 1396 |
| 2 | 914 | 184 | 14 | 37.3 | 1028 |
| 3 | 826 | 165 | 15 | 37.6 | 916 |
| 4 | 749 | 210 | 19 | 40.5 | 1467 |
| 5 | 1054 | 178 | 14 | 27.3 | 933 |
| 6 | 1080 | 172 | 10.5 | 27.3 | 783 |
| 7 | 1118 | 140 | 10 | 37.9 | 788 |
| 8 | 826 | 203 | 12 | 29 | 1295 |

EXAMPLE 2

Effect of Stretching

A fiber produced in manner similar to those in Example 1, from an 18% solids solution of POLY(PTFE-CO-PFVAE) in HaloVac 60 was extracted, stretched 100% and annealed at 275° C. The results in the Table below show the improvement in permeability due to stretching.

| | Unstretched | Stretched |
|---|---|---|
| OD microns | 851 | 723 |
| ID microns | 381 | 343 |
| Wall microns | 229 | 191 |
| IPA visual bubble point (psi) | 15 | 10 |
| IPA mean bubble point (psi) | 38 | 23 |
| IPA flow time (sec) | 2000 | 835 |

EXAMPLE 3

Blends of poly(tetrafluoroethylene-co-perfluoro (methylvinylether)) (A) and poly (tetrafluoroethylene-co-perfluoro(propylvinylether)) (B)

Hollow Fiber membranes were spun in a manner similar to Example 1 with three blends of A and B. The total solids in the paste was 20%. Take-up rate was 50 feet per minute. The cooling bath was dioctyl pthalate at 85 (° C.). Fiber spinning conditions are given in Tables 4 and 5. Membrane characterization data are given in Table 6.

TABLE 4

| Blend A/B | Extruder Barrel temperatures (° C.) Zone 1 | Zone 2 | Zone 3 | Zone 4 | Melt temperature (° C.) | Temperatures (° C.) Die body | Die Nose |
|---|---|---|---|---|---|---|---|
| 90%/10% | 200 | 295 | 295 | 295 | 295 | 285 | 300 |
| 80%/20% | 200 | 295 | 295 | 295 | 295 | 285 | 300 |
| 20%/80% | 200 | 295 | 295 | 295 | 295 | 285 | 310 |

TABLE 5

| Blend A/B | Take-up rate (fpm) | Lumen pump rate (rpm) | Cooling bath Temperature (° C.) |
|---|---|---|---|
| 90%/10% | 50 | 10 | 85 |
| 80%/20% | 50 | 10 | 85 |
| 20%/80% | 50 | 10 | 85 |

TABLE 6

| Blend A/B | Outer diameter Microns | Wall thickness microns | Visual IPA bubble point (psi) | Mean IPA bubble-point (psi) | Flow Time (sec) |
|---|---|---|---|---|---|
| 90%/10% | 953 | 130–279 | 71 | 45 | 1318 |
| 80%/20% | 914 | 130–279 | 16 | 40 | 1194 |
| 20%/80% | 927 | 130–279 | 12 | 44 | 1362 |

EXAMPLE 5

Poly(tetrafluoroethylene-co-hexafluoropropylene) (FEP)

The process conditions for spinning FEP hollow fiber membranes were the same as for the blend membranes of Example 4, except for the barrel temperature and the die temperatures. A 20% solids paste was used. Even though the melting point of FEP, about 258° C., is much lower than poly(tetrafluoroethylene-co-perfluoro(methylvinylether)), it was significantly more difficult to dissolve than either PFA or POLY(PTFE-CO-PFVAE). To spin FEP, the barrel temperature had to be raised from 295° C. to 305° C. and the die nose temp. from 300° C. to 320° C. The membrane properties of FEP hollow fiber membranes spun in this example were; IPA visual BP 12.6 psi., mean BP 40 psi. and flow time 1593 seconds.

Comparative Examples

Hollow fiber membranes were produced using a process similar to that of Example 1 of U.S. Pat. No. 5,032,274. A 19% solution of poly(tetrafluoroethylene-co-perfluoro (propylvinylether)) in HaloCarbon Oil 56 was extruded into a 150° C. cooling bath of Halocarbon 1000N, a poor solvent for the polymer. Extruder barrel temperatures were 150° C., 285° C., 260° C., 280° C., for Zones 1–4. The melt temperature was 308° C. The extruder was run at 300 RPM. The lumen fluid pump was run at 28–30 RPM.

A short portion of hollow fiber membrane was produced with no solvent coating at a take-up rate of 55 feet per minute. The air gap between the die exit and the cooling bath surface was 0.25 inch. The fiber had an OD of 1500 microns and a wall thickness of 250 micron. IPA flow time was 42,735 seconds.

A short portion of hollow fiber membrane was produced using the solvent coating method at a take-up rate of 50 feet per minute. Halocarbon 56 was co-extruded with the fiber. The air gap was 0.50 inch. The OD was 2000 microns and the wall thickness was 250 microns. IPA flow time was 3315 seconds.

These examples illustrate that fibers produced by the earlier method are not able to produce fiber with the desirable property of low flow times. Low flow times relate to higher membrane permeability and shorter filtration times.

EXAMPLE 6

In this example a skinless contactor hollow fiber membrane made from the 30% polymer solution described above was compared to a skinned fiber made from a 30% polymer solution according to the method of MCA 422, our number, serial number not yet assigned. A gas mixture containing ozone, a highly water soluble gas, was contacted with water using these membranes.

A skinless contactor hollow fiber membrane was made by the following method. Powdered Hyflon MFA (Ausimont, Thorofare, N.J.) was mixed with HaloVac 60 from Halocarbon Oil Inc Halocarbon Products Corporation, River Edge, N.J. to produce a paste of 30% polymer content which was fed by a Moyno (Springfield, Ohio) melt pump into a Baker-Perkins (Saginaw, Mich.) twin-screw extruder. The extruder barrel temperatures were set to between 180–288° C. A Zenith (Waltham, Mass.) melt pump was used to meter the melt into the special hollow fiber die mentioned above. The die annulus was about 300 micron. Halocarbon oil, Halovac-60 was fed by Zenith pump in the lumen to maintain the hollow portion of the fiber. The melt pump and the lumen oil pump were adjusted to produce a fiber with about 200 micron wall and 700 micron lumen. The temperature of the bath liquid, mineral oil, was set to 70° C. After centering of the lumen needle, the die was submerged horizontally under the quench liquid and the fiber was taken up by a set of Godet rolls running at 100 feet per minute. The fiber was extracted by (1,1 dichloro-1-fluorethane, (Florocarbon 141b, Genesolve 2000 Allied-Signal, N.J.) and dried subsequently. This fiber had an IPA visual bubble point of >40–50 psi with an IPA flow time 12,000 sec. The intrusion pressure for these fibers was 8–10 psi.

Figure 11:
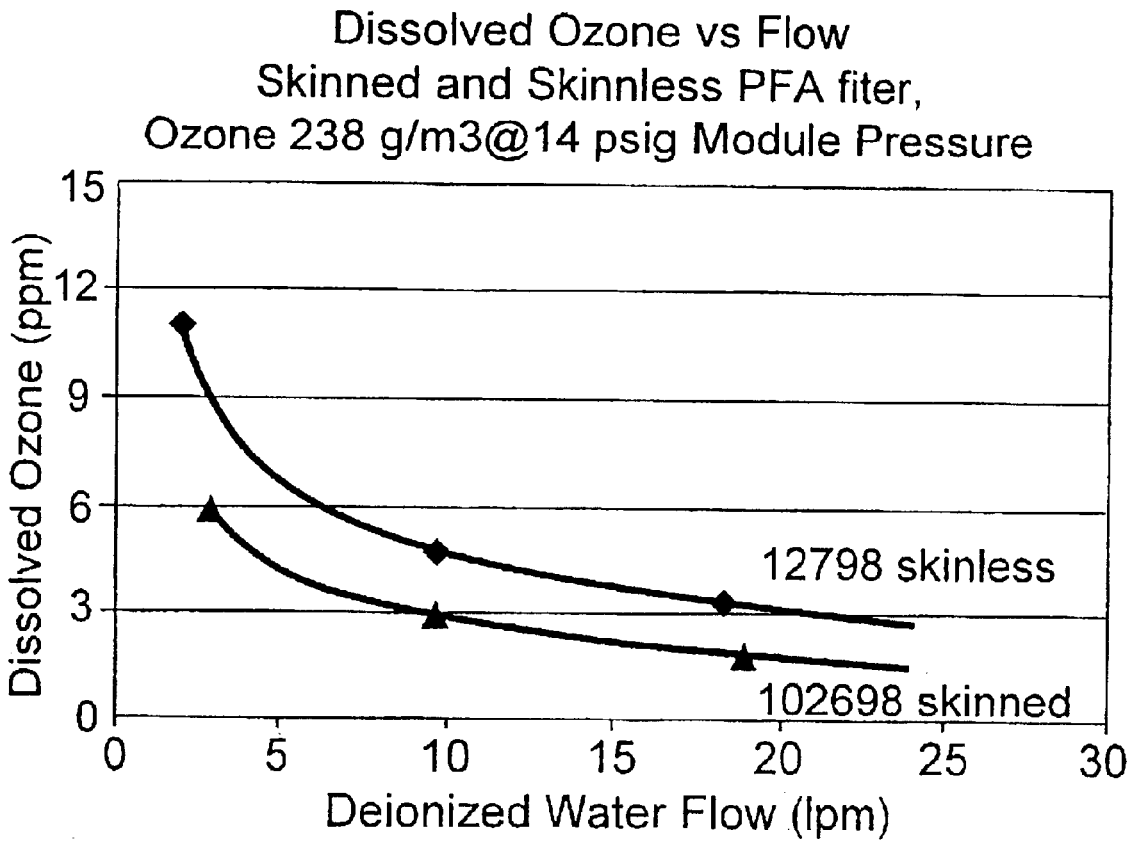
FIG. 11 is a chart comparing the performance of hollow fiber membrane contactors made from skinned membranes to a contactor made from unskinned membranes in water ozonation.

Each contactor was installed onto the test stand depicted in the FIG. 11. Deionized water at 23° C. temperature and a pH of 6.2 was pumped through the lumen side of the membranes at varying flow rates. Water from the deionized water system (not shown) enter through valve 142 with bypass valve 141 closed. Pressure gauges 150, 151 measure the water flow pressure drop across the contactor. The ozone contactor 160 was either one containing skinned membranes (102698 unit) or one with skinless membranes (12798 unit). Ozone gas from a Sorbious Semozon 090.2 HP ozone generator was fed at a flow rate of 2 standard liters per minute (slpm) through inlet 130 to the shell side of the contactor unit (160). Contactor gas pressure was measured by pressure gauge 152 and controlled by pressure controller 180. Outlet gas sensor 112 measured outlet ozone concentration. The dissolved ozone in the contactor outlet stream was measured by ozone sensor 111. The dissolved ozone in the overflow rinse bath 100 was measured using an Orbisphere Model 3600 dissolved ozone sensor 110. Liquid flow was changed from 3.6 to 20 lpm by adjusting valve 140 and the inlet liquid pressure. Gas pressure into the shell side of the contactor was adjusted to make the pressure of the gas just low enough below the pressure of the liquid to prevent the formation of bubbles in the liquid as gas was transferred to the liquid through the membrane.

FIG. 10 is a plot of dissolved ozone in the outlet water measured in parts per million (ppm) ozone. vs. DI water flow rate in liters per minute for each contactor. The results show that the dissolved ozone in water decreases with increasing DI water flow rate and that the skinless fiber contactor dissolves more ozone into the DI water than the ozone contactor (102698) containing the skinned fiber.

EXAMPLE 7

The skinned and skinless membranes of example 6 were compared in a test with carbon dioxide, a highly water-soluble gas.

For each contactor used in this Example, a bundle of fibers was made, potted and installed in a cylindrical holder to make a contactor that separated the lumen side from the shell or outer side of the fibers. Fiber ID was 500$\mu$ and the fiber wall was about 150$\mu$ The number of fibers was about 500 and the length of the module was about 43 cm. Contactors were used to test for gasification efficiency. In this mode, water degassed by a Hoechst Liquid Cel degasser at 20° C. was pumped through the fiber lumens. Air containing carbon dioxide was pumped at low-pressure drop across the shell side of the fibers. For all practical purpose, the absolute gas pressure was assumed to be 760 mm Hg. The ozone concentration of the feed and the outlet water was measured at different flow rates.

Figure 12:
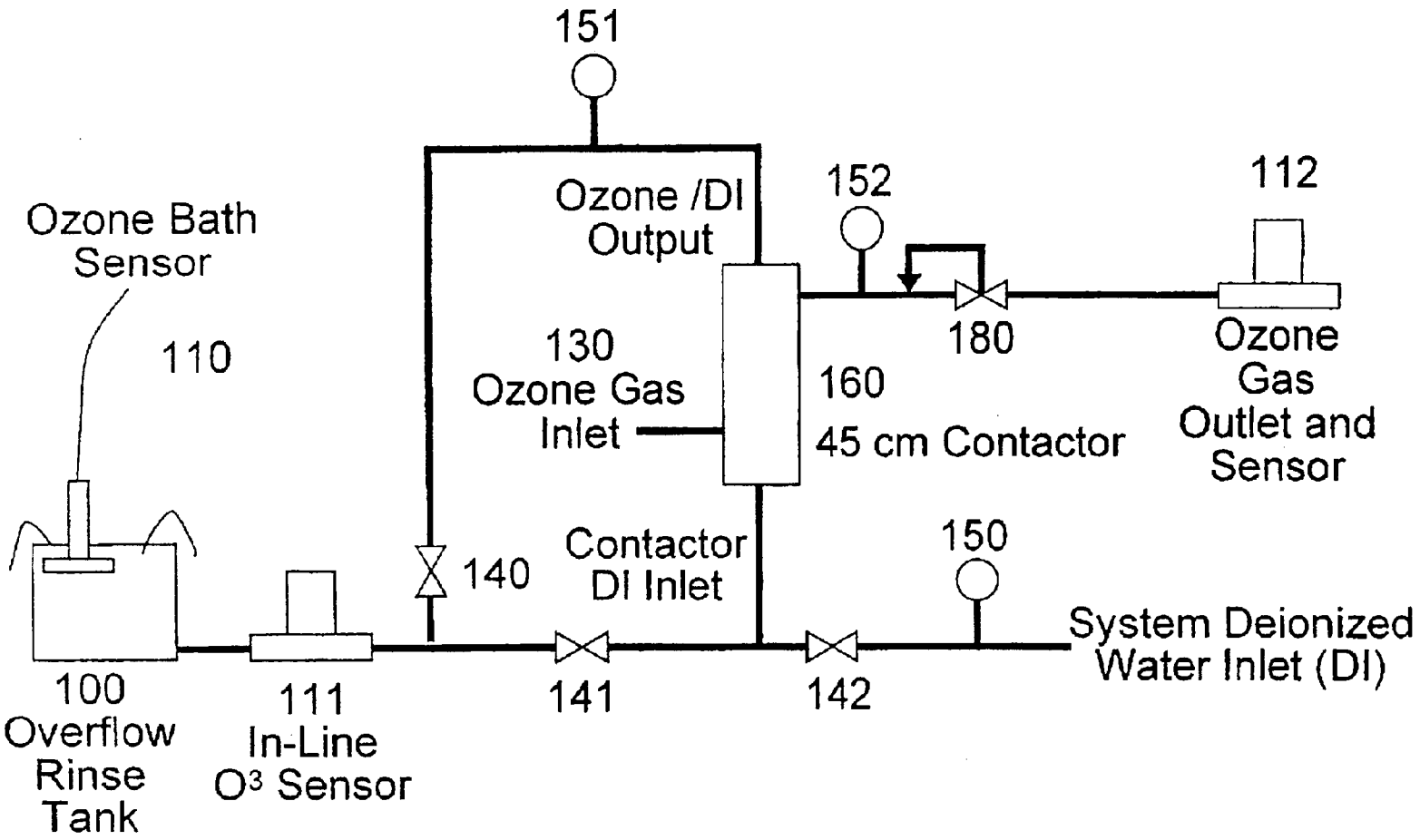
FIG. 12 is a schematic of the test stand used to compare contactors in fluid-fluid contacting applications.
Figure 13:
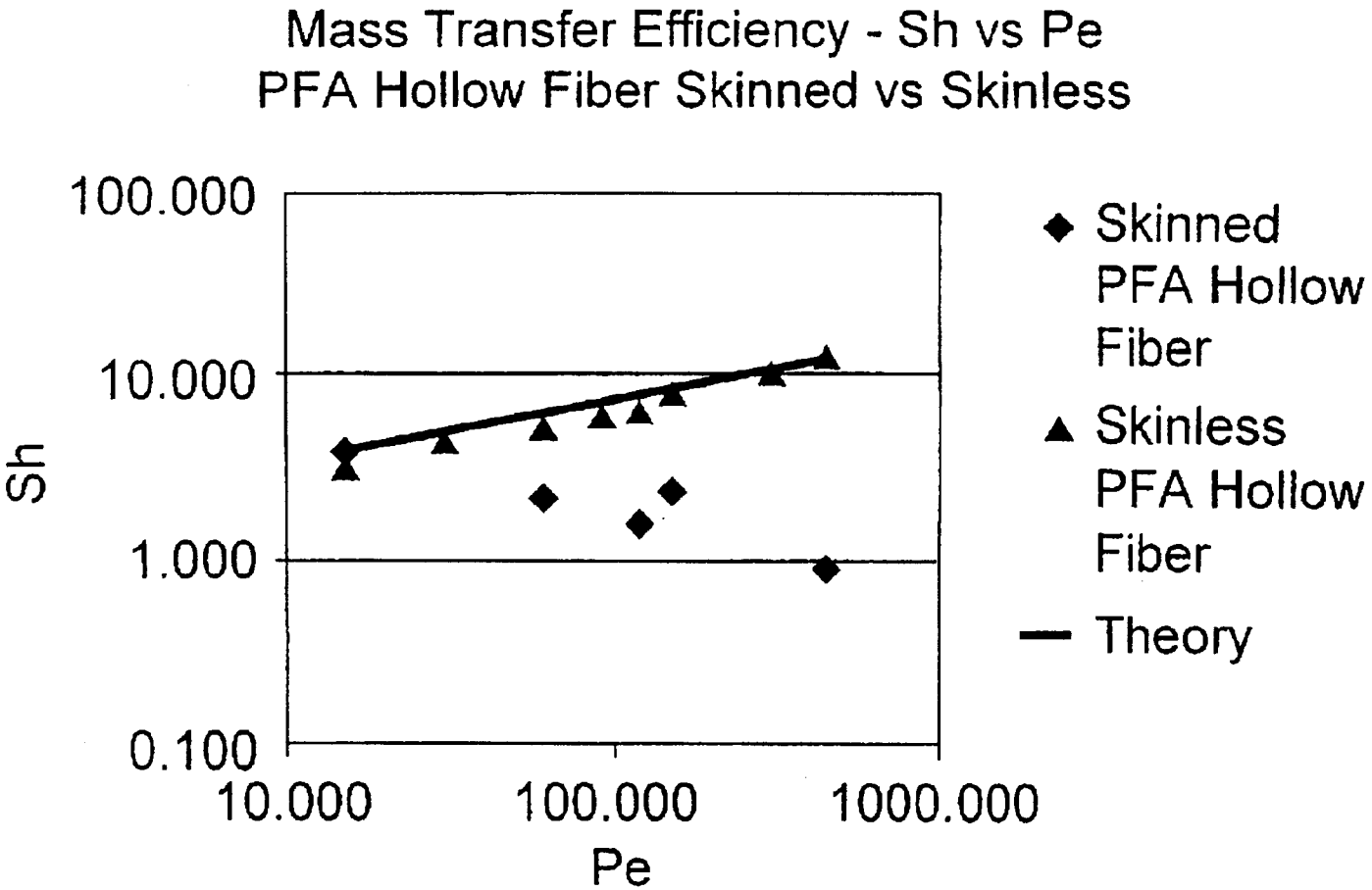
FIG. 13 is a chart comparing absorption of carbon dioxide in water using contactors with skinned membranes and unskinned membranes.

FIG. 12 shows the results and theoretical predictions based on Leveque's solution. The method of data analysis is presented below The mass transfer coefficient, K, was calculated by the following equation:

$$K=-(Q/A)*\mathrm{In}[C_{out}-C^*/C_{in}-C^*]$$

where $C_{out}$ is the carbon dioxide conc. in output liquid [ppm]

$C_{in}$ is the carbon dioxide conc. in input liquid [ppm]

C* is the equilibrium carbon dioxide conc. at the gas pressure on the shell side [ppm]

Q is the flow rate [cc/s]

A is the membrane area [$cm^2$].

The Sherwood number is calculated as follows:

$$Sh=K*D/D_{ab}$$

where

K is the mass transfer coefficient [cm/s],

D is the ID of the fiber [cm] and $D_{ab}$ is the diffusivity of carbon dioxide in water[$cm^2$/s].

The Graetz or Peclet number is calculated as follows:

$$Pe \text{ or } Gr=V*D^2/(L*D_b)$$

Where V is the velocity of flow inside the lumen [cm/s] and L is the length of the fiber [cm]

The Sherwood and Graetz numbers are dimensionless groups used to describe heat and mass transfer operations. The Sherwood number is a dimensionless mass transfer coefficient, and the Graetz number is a dimensionless group that is related to the inverse of the boundary layer thickness.

S. R. Wickramasinghe et al (J. Membrane Sci. 69 (1992) 235–250) analyzed oxygen transport in a hollow fiber membrane contactor using the method of Leveque. A bundle of porous hollow fiber membranes were used. They showed that a plot of the Sherwood number vs. the Graetz number was linear at high values of the Graetz number, in agreement with theoretical predictions. Results at low Graetz number were explained by the polydisperity of fiber diameters, which affects uniformity of flow through the fibers. Their analysis showed that at low Graetz numbers, the average mass transfer coefficient falls below the theoretical prediction due to uneven flow through the fibers. They concluded that oxygen mass transfer was unaffected by the diffusional resistance across the membrane. Conversely, one can conclude that a membrane that follows the prediction of the Leveque theory is porous, because otherwise, the resistance to diffusion would be too high to follow the theory.

The results illustrated in FIG. 12 show that the skinless membranes of this example have a low membrane resistance to ozone transport because they follow the Leveque equation at high Peclet numbers. In the linear region, the relationship between the Sherwood number and the Graetz number is given as $Sh=1.64(Gr)^{0.33}$ for Graetz numbers from between about 5 to about 1000.

What we claim:

1. A method of producing a hollow fiber porous membrane from a perfluorinated thermoplastic polymer having an essentially skinless surface on at least one surface comprising;

(a) dissolving said perfluorinated thermoplastic polymer in a solvent that forms an upper critical solution temperature solution with said polymer, (b) extruding said solution through an annular die, a portion of said die being submerged in a cooling bath, and maintained at a temperature sufficiently high to prevent said solution from prematurely cooling, (c) extruding said solution into said cooling bath, (d) cooling said solution to below the upper critical solution temperature to cause separation into two phases by liquid-liquid phase separation, said phases being a polymer rich solid phase, and a solvent rich liquid phase, to form a gel fiber, (e) extracting said solvent from said gel fiber to form a porous hollow fiber membrane, (f) drying said porous hollow fiber membrane under restraint.

2. The method of claim 1 wherein said portion of said die being submerged is the die tip.

3. The method of claim 1 wherein said perfluorinated thermoplastic polymer is dissolved in a concentration of from about 12% to about 35% by weight in a solvent that forms an upper critical solution temperature solution with said polymer.

4. The method of claim 1 wherein step (b) comprises extruding said solution in an essentially horizontal attitude through an annular die, said die maintained at a temperature sufficiently high to prevent said solution from prematurely cooling, wherein the tip of said die penetrates through a wall separating said the body of said die from cooling bath, exposing the die exit to said cooling bath liquid.

5. The method of claim 1 wherein the solvent has a boiling point lower than the temperature of the gel fiber at the die tip exit.

6. The method of claim 1 wherein the solvent is a low molecular weight saturated chlorotrifluorohydrocarbon polymer.

7. The method of claim 6 wherein the solvent is a polychlorotrifluoroethylene oil selected from HaloVac® 60 (polychlorotrifluoroethylene oil) or Halocarbon Oil 56 (polychlorotrifluoroethylene oil) or blends thereof.

8. The method of claim 1 wherein said perfluorinated thermoplastic polymer is poly(tetrafluoroethylene-co-perfluoro(alkylvinylether)) or poly(tetrafluoroethylene-cohexafluoropropylene).

9. The method of claim 8 wherein the alkyl of said poly(tetrafluoroethylene-coperfluoro(alkylvinylether)) is propyl, methyl, or of blends of methyl and propyl.

10. The method of claim 1 wherein said cooling bath liquid consists of a non-solvent for said perfluorinated thermoplastic polymer.

11. The method of claim 8, wherein said cooling bath liquid consists of a non-solvent for said perfluorinated thermoplastic polymer.

12. The method of claim 1 wherein said cooling bath liquid consists of the group selected from silicone oil or dioctylpthalate.

13. The method of claim 8, wherein said cooling bath liquid consists of the group selected from silicone oil or dioctylpthalate.

14. A hollow fiber porous membrane produced from a perfluorinated thermoplastic polymer having an essentially skinless surface on at least one surface, and a IPA flow time of less than about 3000 seconds produced by the method of claim 1.

15. The membrane of claim 14 wherein said membrane is asymmetric.

16. The membrane of claims 14 wherein said perfluorinated thermoplastic polymer is selected from the group consisting of poly(tetrafluoroethylene-co-perfluoro (alkylvinylether)) or poly(tetrafluoroethylene-co-hexafluoropropylene).

17. The membrane of claim 16, wherein the alkyl of said poly(tetrafluoroethylene-coperfluoro(alkylvinylether)) is selected from the group consisting of essentially all propyl, of essentially all methyl, or blends of methyl and propyl.

* * * * *